US008634729B2

(12) United States Patent
Okamoto et al.

(10) Patent No.: US 8,634,729 B2
(45) Date of Patent: Jan. 21, 2014

(54) IMAGE FORMING APPARATUS AND IMAGE FORMING SYSTEM WITH WINDING DETECTION

(75) Inventors: Akira Okamoto, Hino (JP); Kenji Yamamoto, Hachioji (JP); Kazumichi Yamauchi, Hachioji (JP); Hideki Nakamura, Hachioji (JP); Kazutoshi Yoshimura, Hino (JP); Masatoshi Ogawa, Tomisato (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 338 days.

(21) Appl. No.: 12/944,148

(22) Filed: Nov. 11, 2010

(65) Prior Publication Data

US 2011/0116813 A1 May 19, 2011

(30) Foreign Application Priority Data

Nov. 16, 2009 (JP) ..... 2009-261254

(51) Int. Cl.
*G03G 15/00* (2006.01)

(52) U.S. Cl.
USPC ..... 399/22; 399/18; 399/21

(58) Field of Classification Search
USPC ..... 399/22, 18, 19, 21, 16, 397–399
See application file for complete search history.

(56) References Cited

U.S. PATENT DOCUMENTS

| | | | | |
|---|---|---|---|---|
| 5,809,391 | A * | 9/1998 | Fujita et al. | 399/396 |
| 6,333,774 | B1 * | 12/2001 | Ito et al. | 355/26 |
| 6,643,474 | B2 * | 11/2003 | Kodama et al. | 399/21 |
| 7,957,688 | B2 * | 6/2011 | Takiguchi et al. | 399/398 |
| 2005/0286916 | A1 * | 12/2005 | Nakazato et al. | 399/16 |
| 2008/0075509 | A1 * | 3/2008 | Takiguchi et al. | 399/388 |

FOREIGN PATENT DOCUMENTS

| | | |
|---|---|---|
| JP | 6-337595 | 12/1994 |

* cited by examiner

*Primary Examiner* — Daniel J Colilla
*Assistant Examiner* — Justin Olamit
(74) *Attorney, Agent, or Firm* — Finnegan, Henderson, Farabow, Garrett & Dunner, L.L.P.

(57) ABSTRACT

An image forming apparatus includes: a sheet conveyance section having a sheet storing member to store sheets that have been aligned in a prescribed placing direction, which conveys a sheet stored in the sheet storing member; an image forming section having an image carrier, which forms an image on the image carrier; an image transfer section which transfers the image formed on the image carrier onto a sheet conveyed by the sheet conveyance section; a winding detection section which detects whether or not the sheet conveyed by the sheet conveyance section is wound around the image carrier; and a controller which controls to instruct an operator to conduct a change operation of the placing direction of the sheets stored in the sheet storing member based on a sheet winding detection signal outputted from the winding detection section.

5 Claims, 20 Drawing Sheets

IMAGE FORMING APPARATUS AND IMAGE FORMING SYSTEM WITH WINDING DETECTION

This application is based on Japanese Patent Application No. 2009-261254 filed on Nov. 16, 2009, which is incorporated hereinto by reference.

BACKGROUND OF THE INVENTION

The present invention relates to an image forming apparatus and an image forming system which can be applied to a copying machine and a printer each being equipped with functions to watch the state of winding of a sheet around a drum when transferring a toner image onto the cut sheet, and to carry out sheet feed control, corresponding to the past record of the winding around the drum.

Up to this time, there have been many occasions to use an image forming apparatus such as a copying machine and a printer wherein a large-sized sheet is cut to the prescribed sheet size, and an image is formed on the sheet that has been cut to the prescribed sheet size (hereinafter referred also to a cut sheet). For example, in the case of an image forming apparatus of an electrophotographic type, it is composed of a sheet cassette, an image forming section and a fixing device. In the sheet feed cassette, a plurality of sheets are stored.

The sheet feed cassette naturally stores sheets which are formed by cutting with a blade for cutting use by pressing the blade against a bundled sheets in the fixed direction from the upper surface thereof. It is known that projections called burrs are generated on the sheets which have been cut by a blade for cutting use. It is also known that the burrs are generated in many cases wherein they are generated on the lower side of a cut surface without being generated on the upper surface, when bundled sheets are cut.

A sheet having been fed out of a sheet feed cassette is conveyed to an image forming section. On the image forming section, there are provided an image writing section, a photoconductor drum, a developing section and a transfer section. On the photoconductor drum, there is formed an electrostatic latent image by the image writing section based on, for example, image data, and this electrostatic latent image is developed by the developing section. The electrostatic latent image on the photoconductor drum is developed to be a toner image. The toner image formed on the photoconductor drum is transferred onto a sheet by a transfer section. The toner image transferred onto the sheet is fixed by the fixing device. The sheet having undergone the fixing is ejected.

Each of FIGS. 19A-19C is an illustration showing image forming apparatus 500 relating to a traditional example and an example of transfer for sheet P. The image forming apparatus 500 shown in FIG. 19A is composed of photoconductor drum 41, transfer section 42 and of second sheet feed section 66. In the example of transfer for sheet P, the sheet P is conveyed in the sheet feed direction I shown with an arrow, and a toner image is transferred onto sheet P from photoconductor drum 41, in a space between photoconductor drum 41 and transfer section 42.

Therefore, even when sheet P shown in FIG. 19B is a cut sheet, no phenomenon of winding of sheet P around photoconductor drum 41 is generated, when no burrs exist on a cut surface of cut sheet P (when burrs are not generated). With respect to the cut sheet, there is sometimes an occasion when a large-sized sheet is cut by the use of a laser beam having a prescribed intensity, in addition to a blade for cuffing. In this case, sheet P is conveyed to the fixing device side without winding itself around photoconductor drum 41, as shown in FIG. 19C.

Each of FIGS. 20A-20C is an illustration showing an example of winding of sheet P around photoconductor drum 41. In FIG. 20A, burrs Pb (projections) are generated on a cut surface for cut sheets P, and there is sometimes an occasion when the burrs turn downward. In this case, a phenomenon of winding of sheet P around photoconductor drum 41 as shown in FIG. 20B, tends to be generated. Due to this, existence of burrs Pb causes a clearance between sheet P and transfer belt. Therefore, potential on sheet P on the transfer belt side is lowered, then, voltage between photoconductor drum 41 and sheet P is enhanced to increase adhesion, which makes it difficult to separate sheet P from photoconductor drum 41. Owing to this, a phenomenon that sheet P winds itself around photoconductor drum 41 as shown in FIG. 20C is generated.

Relating to the image forming apparatus that separates a sheet from a photoconductor drum of this kind, Unexamined Japanese Patent Application Publication No. H06-337595 discloses an image forming apparatus equipped with an electrostatic separation control device. This image forming apparatus is equipped with an image forming device, a transfer device and an electrostatic separation control device. The transfer device carries out electrostatic transfer for an image formed on a surface of a recording medium through an image forming device, by charging for a transfer material conveyed properly from the reverse side of the transfer material.

The electrostatic separation control device is equipped with a separation device, a voltage supply device, a distance measuring device and a control device, and the supply device supplies voltage for separation to the separation device provided to adjoin a recording medium and a transfer device. The distance measuring device is arranged on the separation device side for detecting the state of separation of transfer material by the separation device, and it measures an isolation distance between a position of arrangement of the distance measuring device and the leading edge of the transfer material after the separation. Under the assumption of the foregoing, voltage supplied by the voltage supply device is controlled, for the control device to carry out separation of transfer material by the separation device corresponding to the distance for measurement by the distance measuring device. If the electrostatic separation control device is constructed in the aforesaid way, a sheet can be released from a recording medium accurately and surely based on actual state of separation.

However, in the image forming apparatus 500 relating to the traditional example, there is a following problem.

i. When sheet P winds itself around photoconductor drum 41, it is difficult, in many cases, to judge whether the cause of its winding is a phenomenon of curl of sheet P by a conveyance roller or whether the cause of its winding is a bur generated in the direction of cutting of a cut sheet. Therefore, when many cut sheets are used, there is a fear for the occasion where phenomena of winding of a sheet around a photoconductor drum caused by the direction of generation of burrs on cut sheets is increased.

ii. Unexamined Japanese Patent Application Publication No. H06-337595 discloses a technology wherein releasing efficiency for sheets is improved by detecting the state of releasing of a sheet from a recording medium and by controlling voltage for the separation device. However, under the condition of only voltage control, a sheet for which the separation is difficult is still in existence, and a measure for the occasion wherein a cause for winding of a sheet around a recording medium is a bur on a cut surface of a cut sheet becomes difficult. Therefore, there is caused a problem that jam clearing operations to clear a sheet from a recording medium such as a photoconductor drum (hereinafter, referred to as an image carrier) are increased.

SUMMARY OF THE INVENTION (1). To achieve at least one of the abovementioned objects, an image forming apparatus reflecting one aspect of the present invention comprises an image forming section that has an image carrier and forms an image on the image carrier, a transfer section that transfers the image formed on the aforesaid image carrier onto a prescribed sheet, a sheet conveyance section that has a storing member that stores the aforesaid sheets aligned in the prescribed placing direction and conveys a sheet to the aforesaid transfer section, a winding detecting section that detects whether a sheet conveyed by the aforesaid sheet conveyance section is wound around the image carrier or not, and a controller that executes display control that urges (instructs) a change of direction for placing the sheets stored in the aforesaid storing member based on sheet winding detection signals outputted from the aforesaid winding detection section.

(2). In the image forming apparatus in the aforesaid item (1), it is desirable that a display section that displays an image that urges a change in the direction for placing the sheet is provided, and the aforesaid controller inputs sheet winding signals, then, it counts the aforesaid sheet winding signals, and accumulates the number of times for the sheets to be wound around the image carrier to compare the accumulated number of times with a reference number of times for comparison, and when the accumulated number of times exceeds the reference number of times for comparison, the controller controls the aforesaid display section so that an image urging placing of sheet-turning inside out or placing of reversing conveyance direction of the sheets stored in the storing member, may be displayed.

(3). In the image forming apparatus in the aforesaid item (2), it is desirable that the aforesaid controller detects operations for the change of the direction of placing sheets stored in the storing member, and resets the aforesaid number of times accumulated based on the operations for the change thus detected.

(4). In the image forming apparatus in the aforesaid item (3), it is desirable that the controller accumulates the number of times for the sheets to wind themselves around the image carrier for each of the storing members, then, detects operations to change a direction of placing a sheet for each storing member, and resets the number of times accumulated for each storing member based on the aforesaid operations for the change thus detected, when plural storing members are provided.

(5). In the aforesaid item (1), it is desirable that a sheet separation detecting section that outputs sheet separation detection signals by detecting a sheet separated from the image carrier is provided, and the controller executes display control that urges a change of a placing direction for the sheets stored in the aforesaid storing member based on sheet separation detection signals outputted from the sheet separation detecting section.

(6). In the aforesaid item (2), it is desirable that an operation section that registers establishment for front and back sides for sheets on the controller for each storing member is provided, and the controller displays on the display section an image that urges placing of conveyance direction reversing for sheets stored in the storing member by the aforesaid operation section, when front and back sides establishment is registered for each storing member, and when the accumulated number of times exceeds the reference number of times for comparison.

(7). In the aforesaid item (6), it is desirable that the controller detects operations for changing for conveyance direction reversing for sheets stored in the storing member, and conducts conveyance direction reversing for a position of an image formed on the image carrier based on the aforesaid operations for the change thus detected.

(8). In any one of the aforesaid items (1) to (7), it is desirable that a display section that displays an image is provided, and the controller controls the aforesaid display section so that an image that urges placing for sheet-turning inside out or conveyance direction reversing for an operator may be displayed.

(9). To achieve at least one of the abovementioned objects, an image forming apparatus reflecting one aspect of the present invention comprises an image forming section that has an image carrier and forms an image on the image carrier, a transfer section that transfers an image formed on the aforesaid image carrier onto a prescribed sheet, a sheet conveyance section that has a storing member which stores sheets and conveys a sheet to the transfer section, a winding detecting section that detects whether a sheet conveyed by the aforesaid sheet conveyance section is wound around the image carrier or not, and a controller that executes sheet reversing and conveyance control that reverses the conveyance direction for sheets stored in the storing member based on sheet winding detection signals obtained from the aforesaid winding detection section.

(10). In the aforesaid item (9), it is desirable that the sheet conveyance section has a sheet reversing and conveyance path that reverses the sheet upside down, and the controller inputs sheet winding signals, then, accumulates the number of times for the sheet to wind around the image carrier by counting the number of times for the sheet winding signals, and compares the accumulated number of times with a reference number of times for comparison, to control the aforesaid sheet reversing and conveyance path so that the direction of conveyance of a sheet conveyed from the storing member may be reversed, when the accumulated number of times exceeds the reference number of times for comparison.

(11). In the aforesaid item (10), it is desirable that a sheet separation detecting section that detects a sheet separated from the image carrier and outputs sheet separation detection signals is provided, and the controller controls the sheet reversing and conveyance path to reverse the conveyance direction for a sheet conveyed from the storing member or to keep the conveyance direction as it is, based on the sheet separation detecting signals outputted from the sheet separation detecting section.

(12). To achieve at least one of the abovementioned objects, an image forming system reflecting one aspect of the present invention comprises an image forming section that has an image cannier and forms an image on the image carrier, a transfer section that transfers an image formed on the aforesaid image carrier onto a prescribed sheet, a winding detecting section that detects whether a sheet transferred by the aforesaid transfer section is wound around the image carrier or not with the aforesaid transfer section, an image forming apparatus having a controller that controls the conveyance direction for the sheet based on sheet winding detection signals obtained from the winding detecting section and a sheet feed device that has plural storing members each storing the sheets and supplies a sheet to the image forming apparatus, and the controller inputs the sheet winding detection signals and executes a sheet reversing and conveyance control that reverses the conveyance direction for a sheet stored in the aforesaid storing member based on the sheet winding detection signals.

(13). In the aforesaid item (12), it is desirable that the sheet feed device has a sheet reversing and conveyance path that reverses the sheet inside out, and the controller inputs sheet winding signals, then, counts the sheet winding signals and accumulates the number of times for the sheet to wind around the image carrier to compare the accumulated number of times with a reference number of times for comparison, and the controller controls the sheet reversing and conveyance path so that the conveyance direction for a sheet to be conveyed to the image forming apparatus from the aforesaid storing member may be reversed, when the accumulated number of times exceeds the reference number of times for comparison.

Figure 4A:
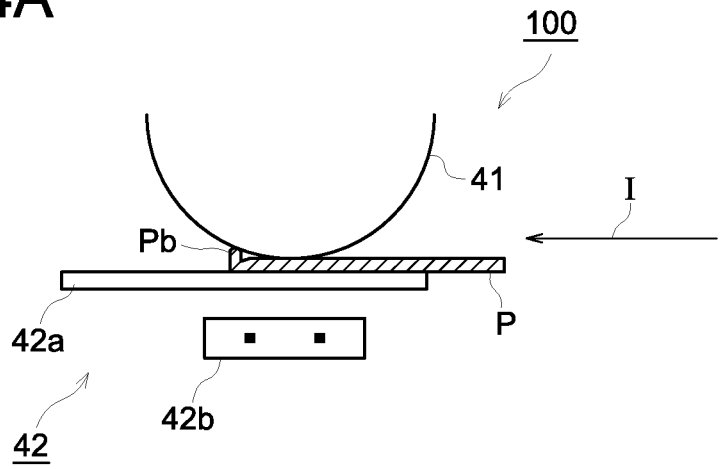
Figure 4B:
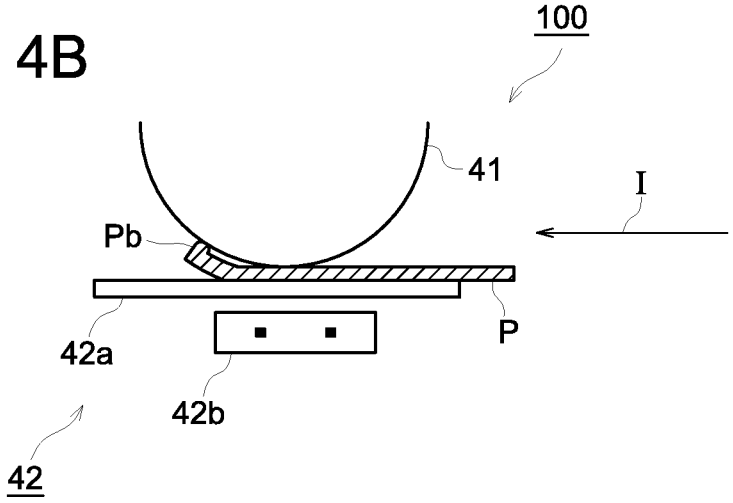
Figure 4C:
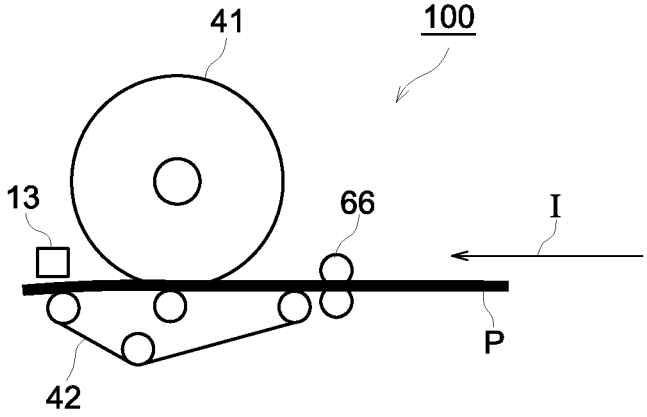

Each of FIGS. 4A-4C is an illustration showing an example of transfer for sheet P.

Figure 5A:
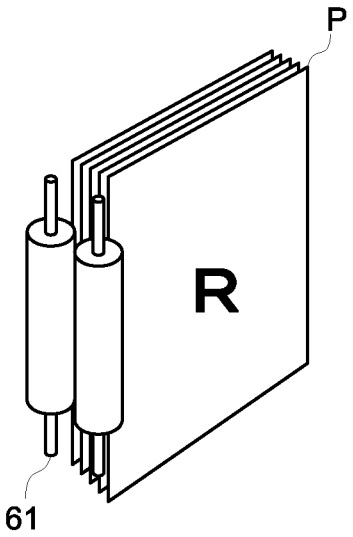
Figure 5B:
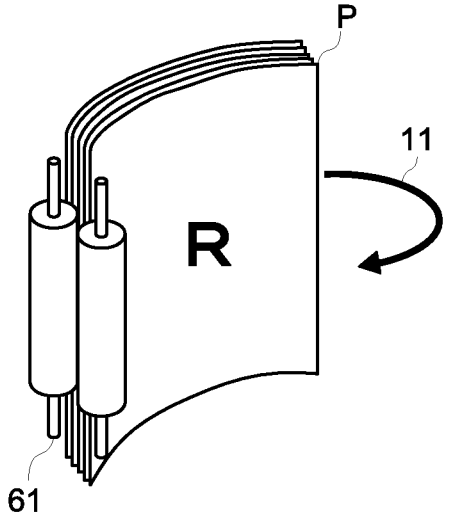
Figure 5C:
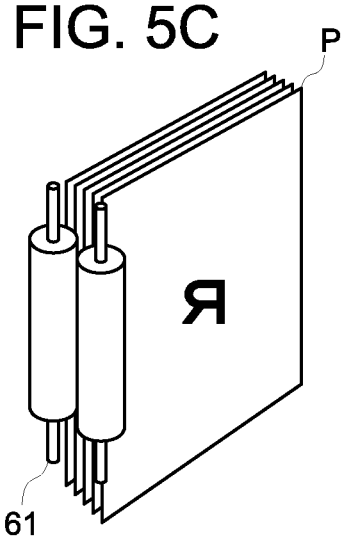

Each of FIGS. 5A-5C is an illustration showing an example of sheet-turning inside out.

Figure 6:
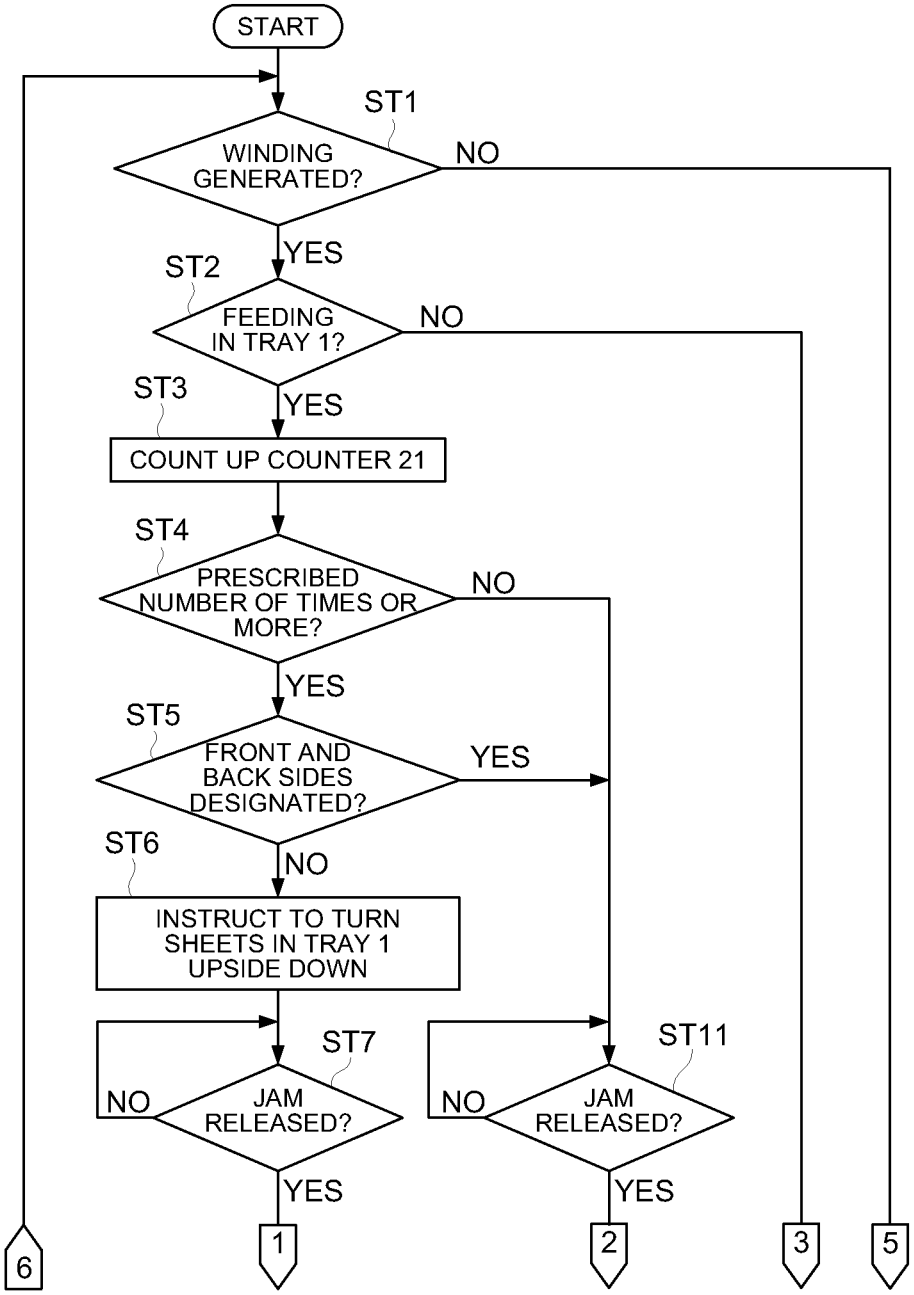

FIG. 6 is a flow chart showing an example of display control for sheet-turning inside out (Part 1) in copying machine 100.

Figure 7:
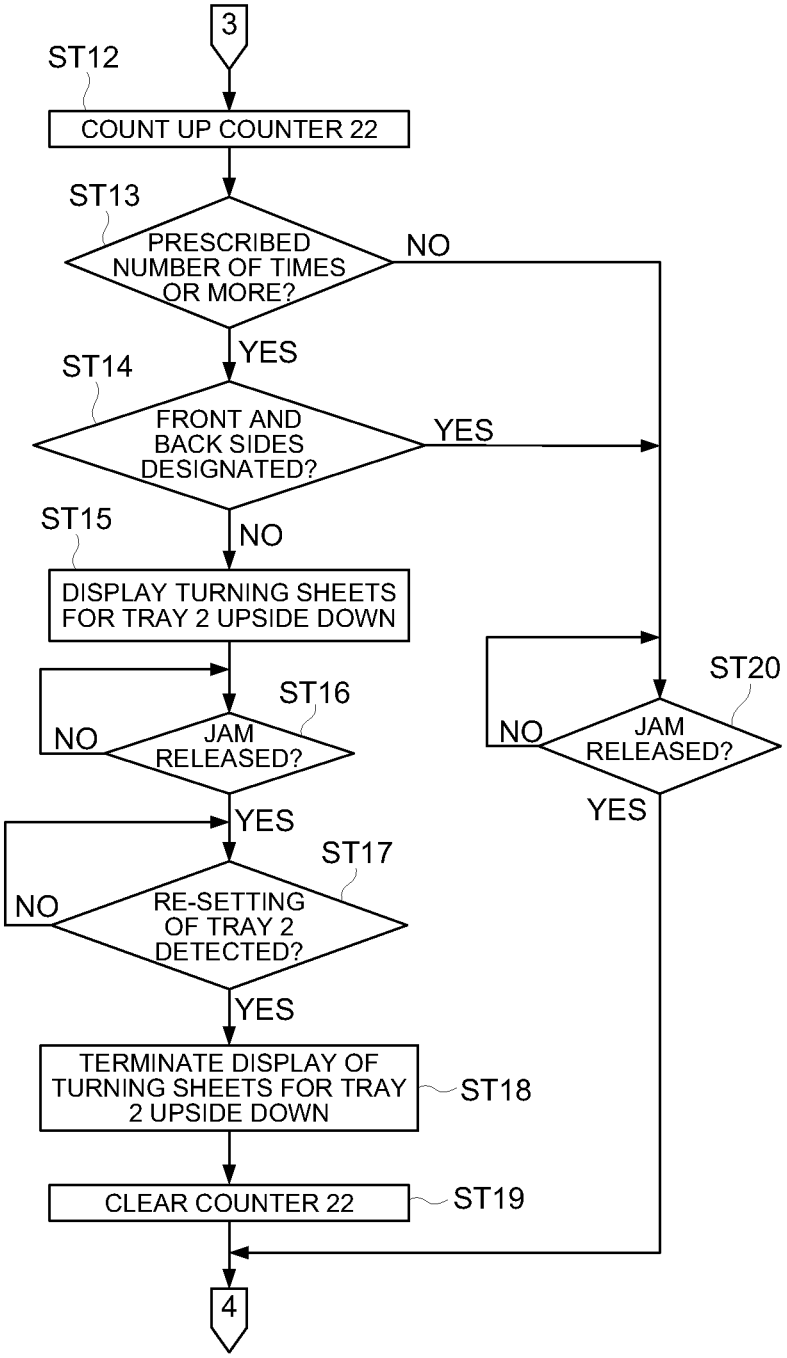

FIG. 7 is a flow chart showing an example of display control for sheet-turning inside out (Part 2) in copying machine 100.

Figure 8:
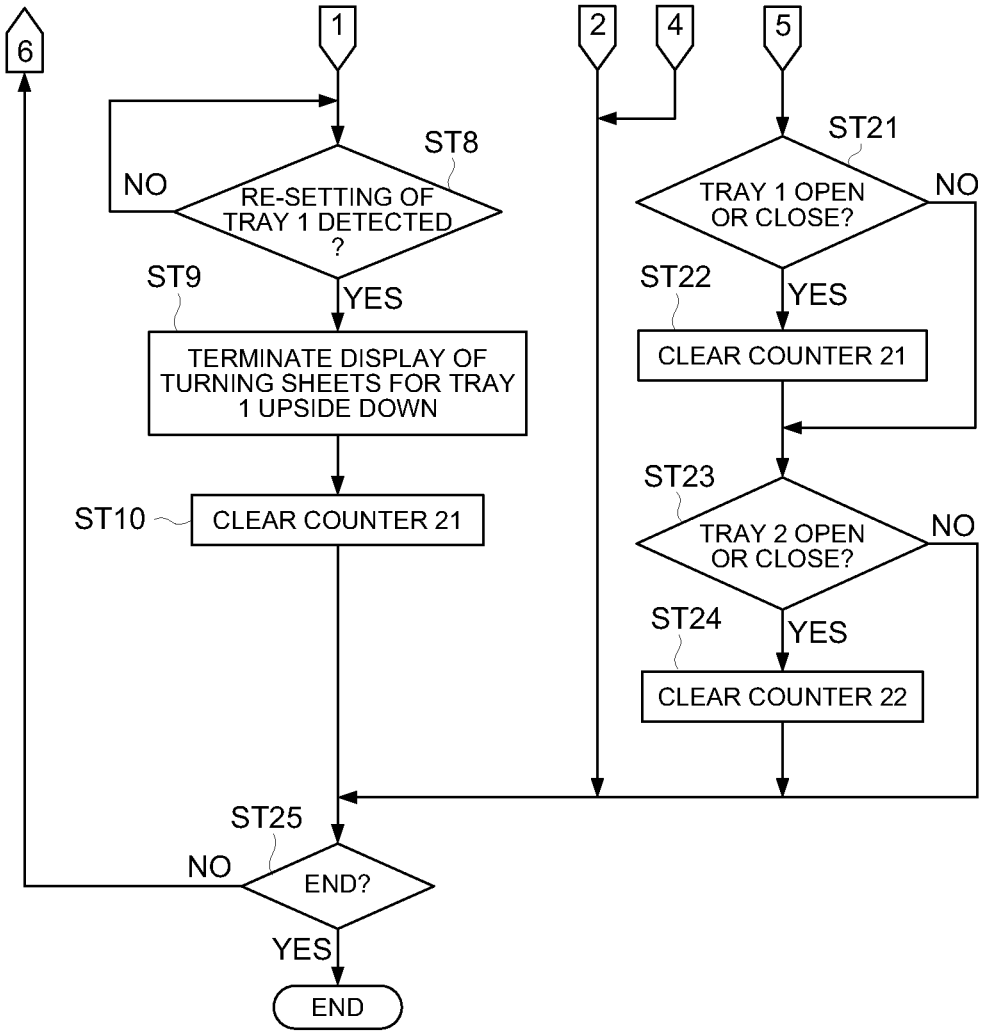

FIG. 8 is a flow chart showing an example of display control for sheet-turning inside out (Part 3) in copying machine 100.

Figure 9:
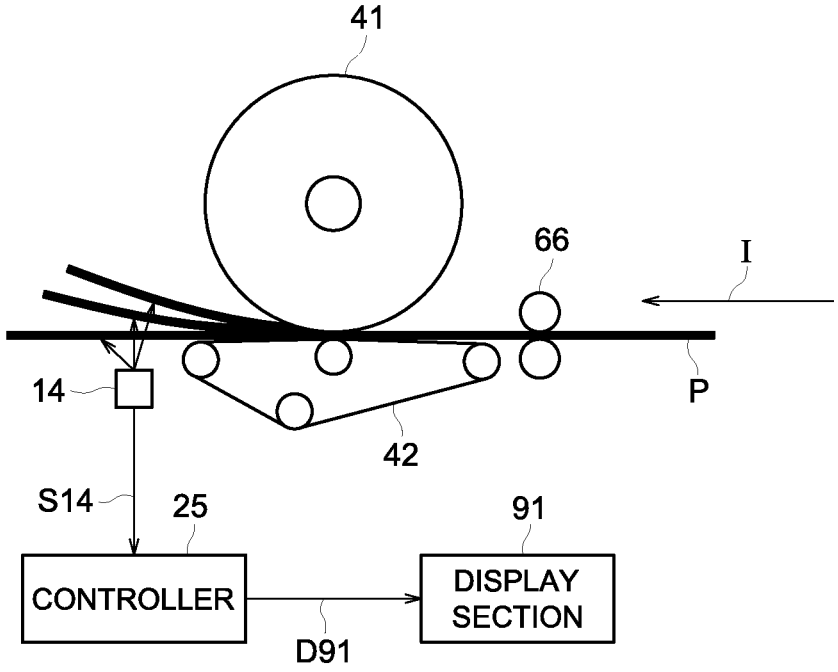

FIG. 9 is an illustration showing an example of an arrangement of separation sensor section 14 as the second embodiment and an example of their functions.

Figure 10:
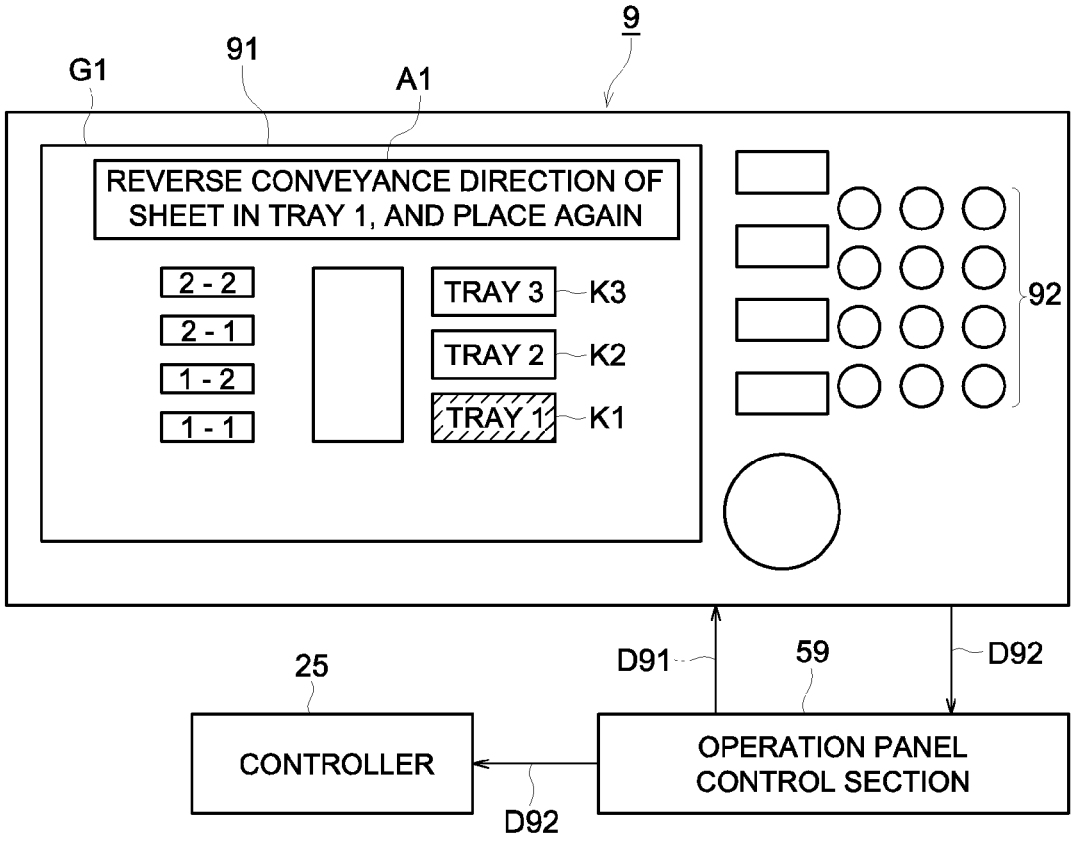

FIG. 10 is an illustration showing an example of display for tray selection screen G1 in operation and display section 9 as the third embodiment.

Figure 11A:
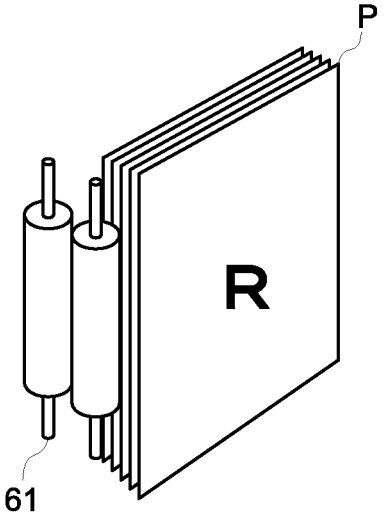
Figure 11B:
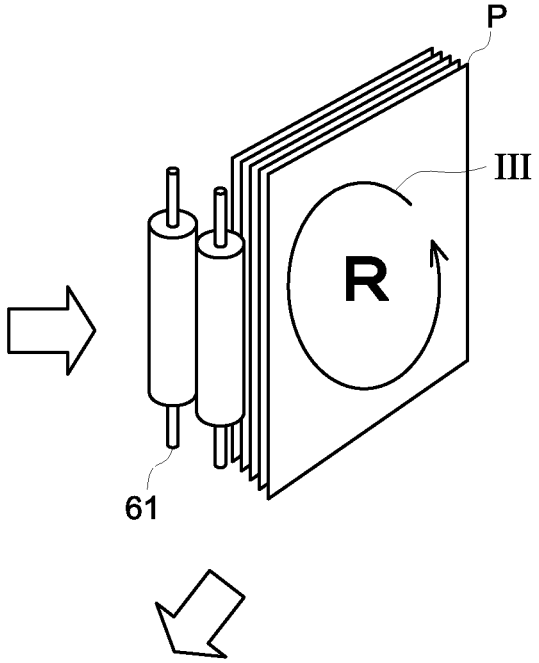
Figure 11C:
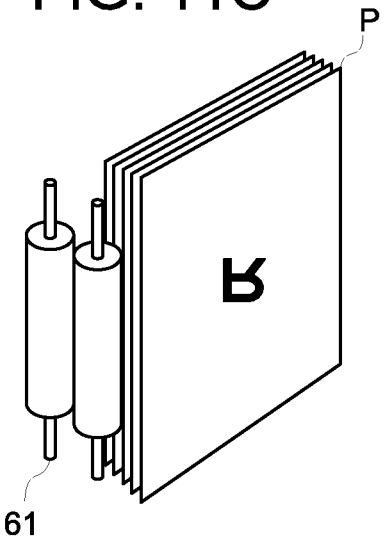

Each of FIGS. 11A-11C is an illustration showing an example of conveyance direction reversing for sheet P.

Figure 12A:
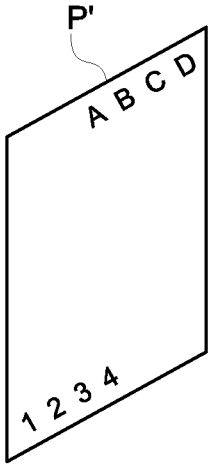
Figure 12B:
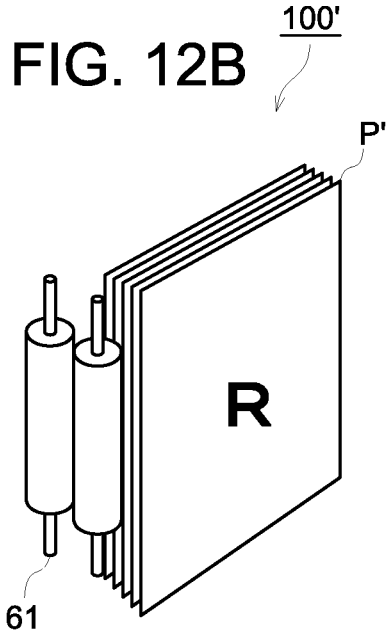
Figure 12C:
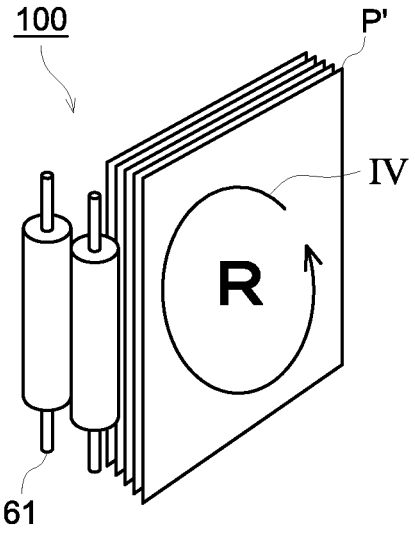

Each of FIGS. 12A-12C is an illustration showing an example of conveyance direction reversing for sheet P (Part 1) as a fourth embodiment.

Figure 13A:
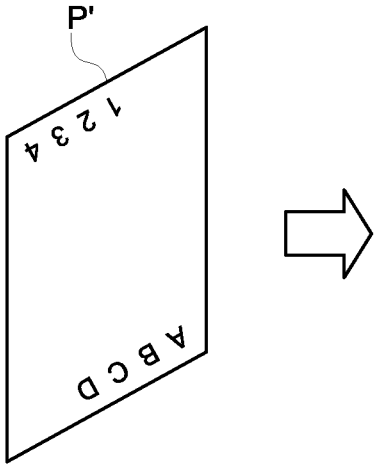
Figure 13B:
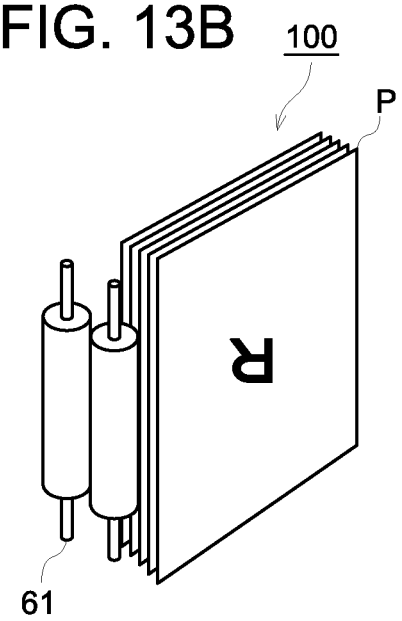
Figure 13C:
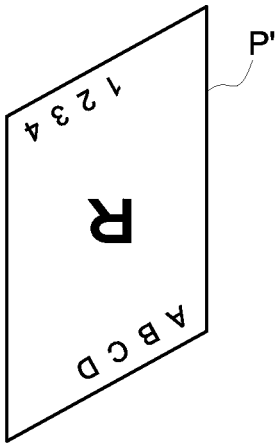

Each of FIGS. 13A-13C is an illustration showing an example of conveyance direction reversing for sheet P (Part 2).

Figure 14:
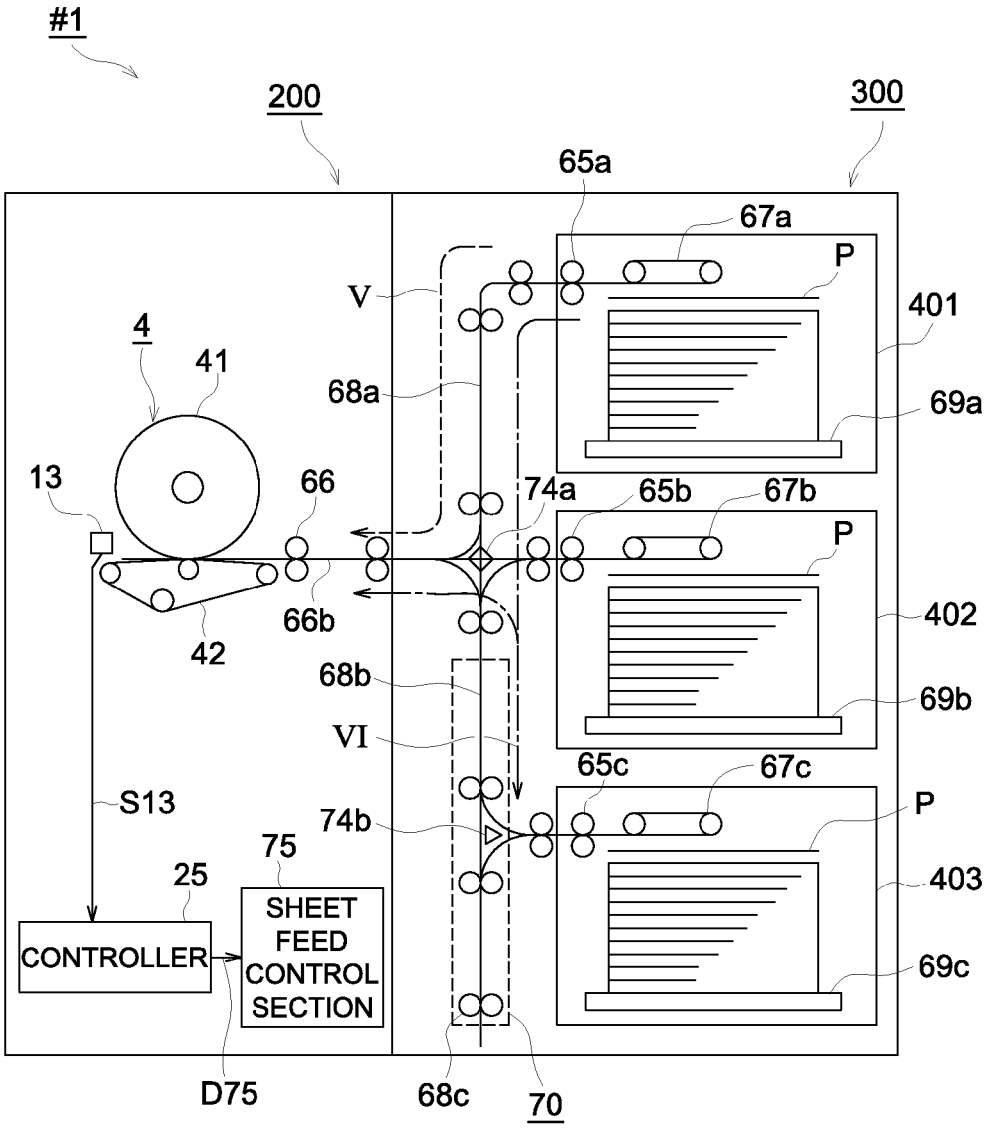

FIG. 14 is an illustration showing an example of structure of image forming system #1 representing the fifth embodiment.

Figure 15:
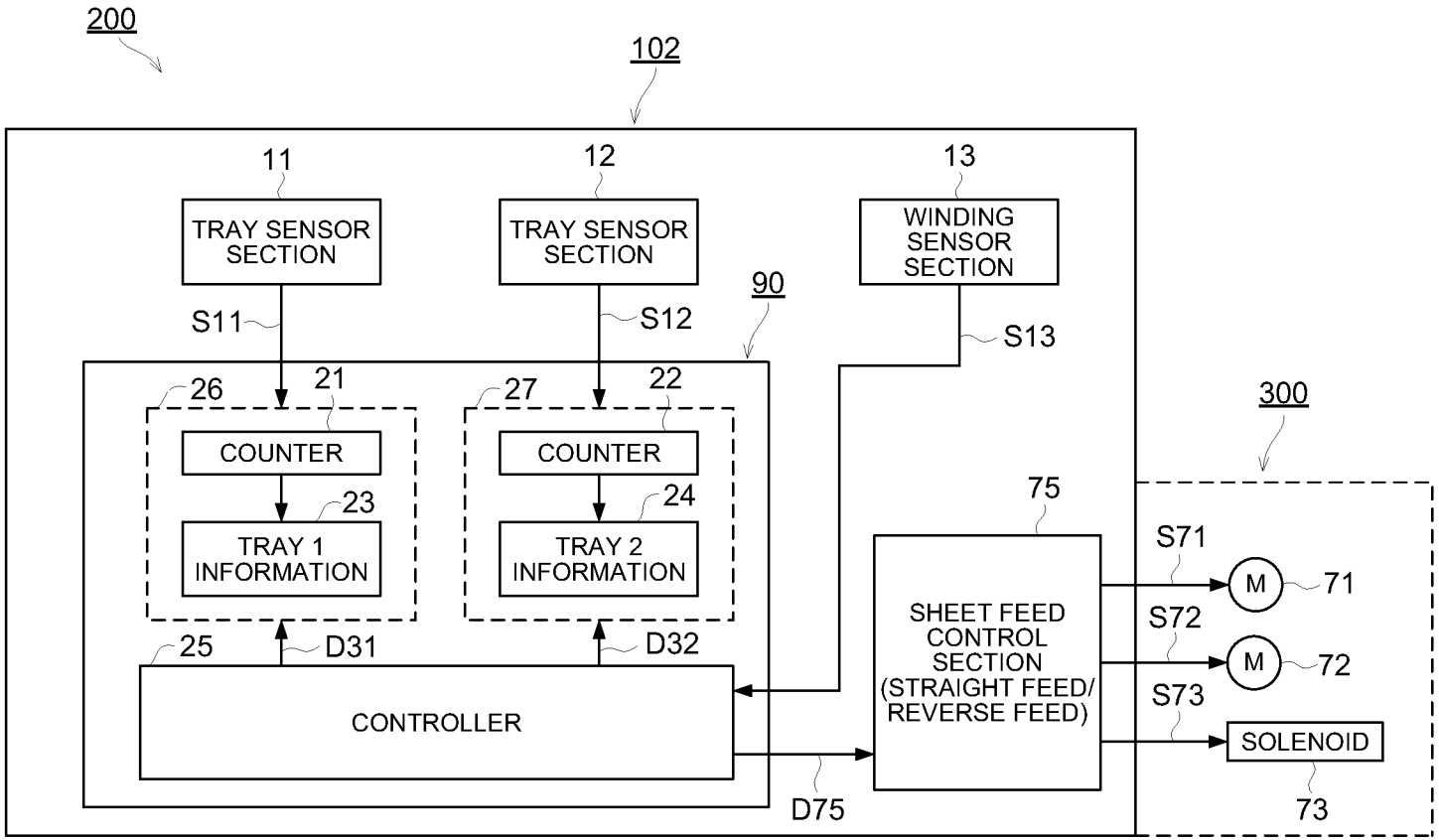

FIG. 15 is a block diagram showing an example of structure of a control system of copying machine 200.

Figure 16:
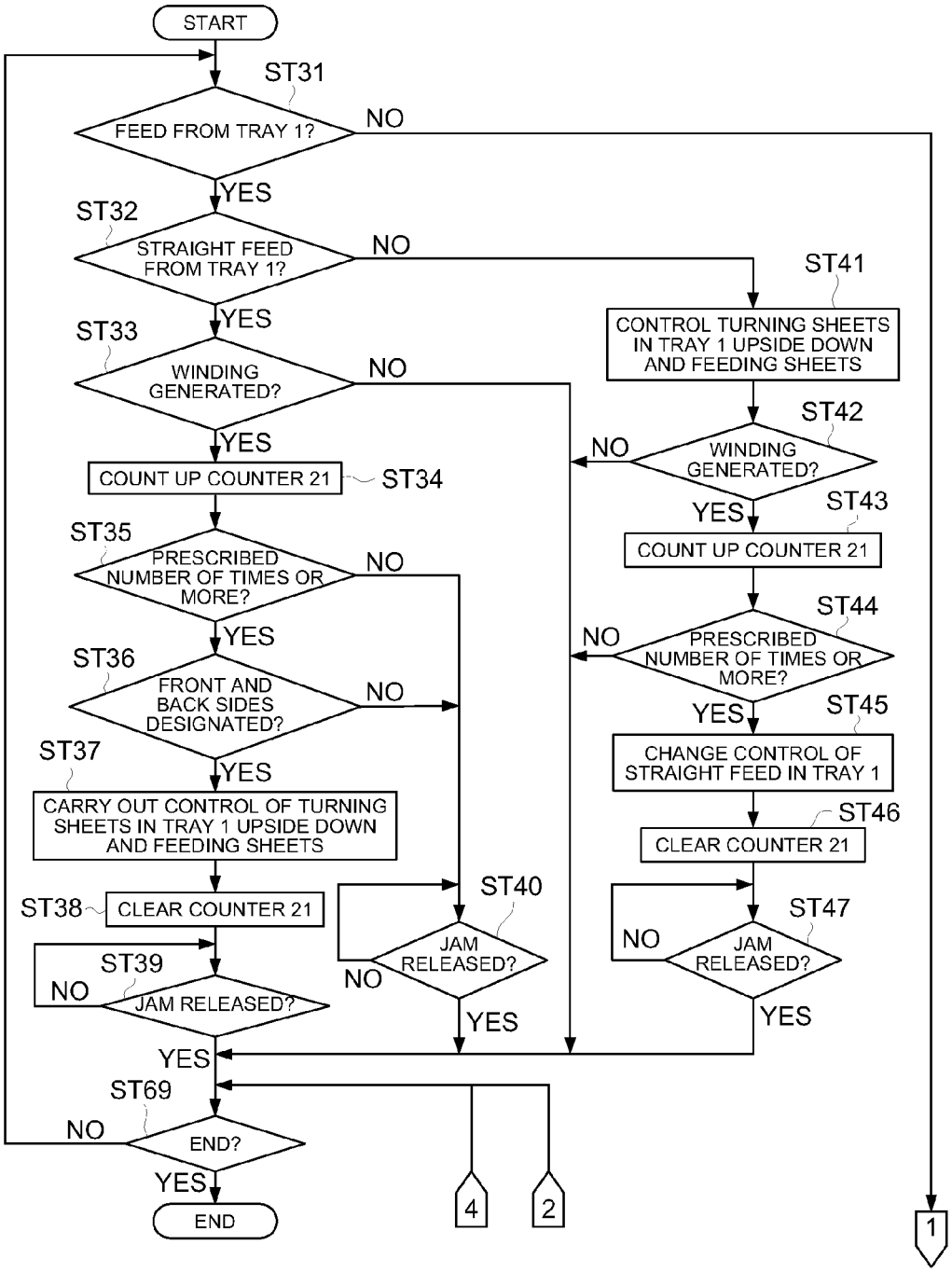

FIG. 16 is a flow chart showing an example of automatic sheet-turning inside out sheet feed control (Part 1) in image forming system #1.

Figure 17:
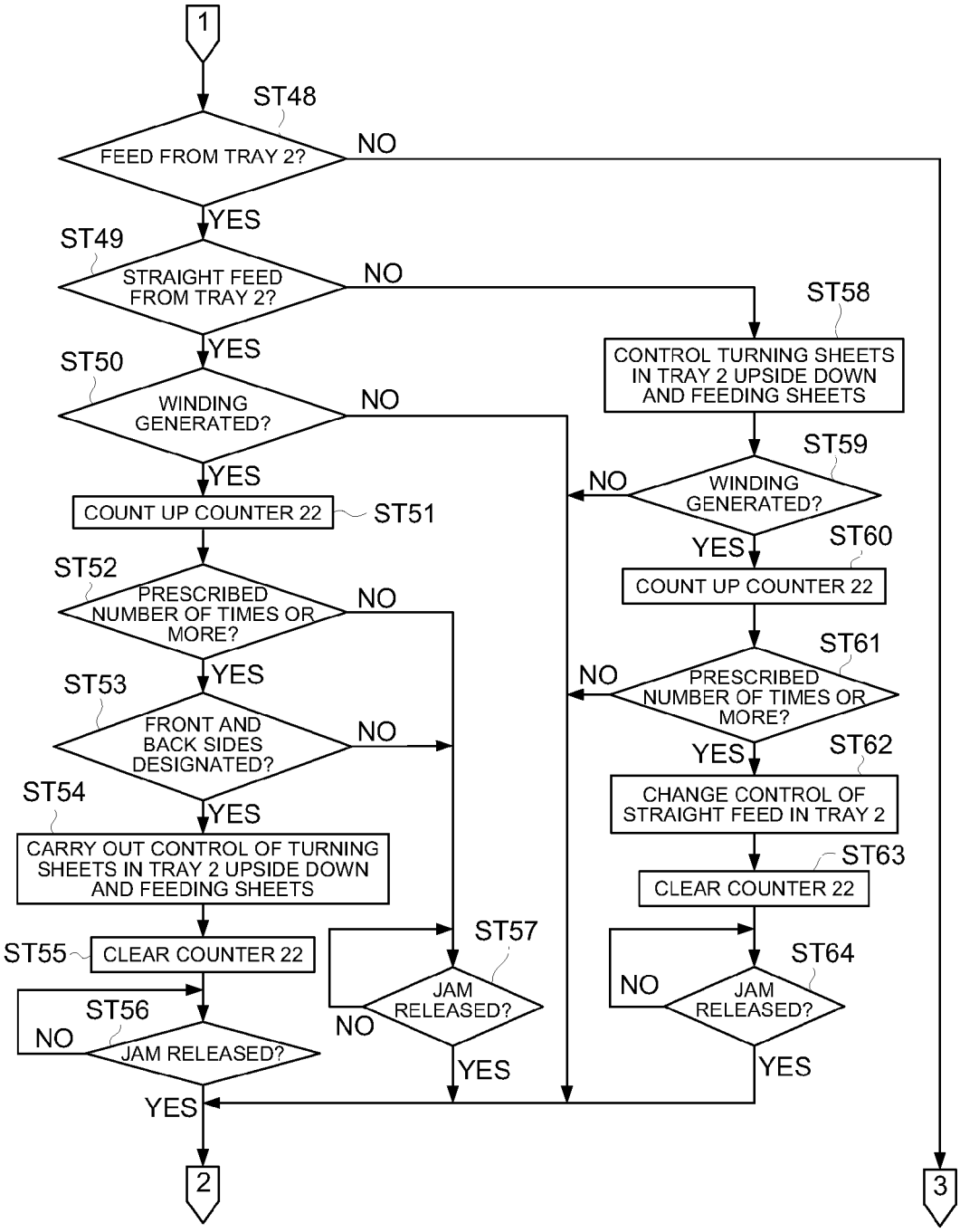

FIG. 17 is a flow chart showing an example of automatic sheet-turning inside out sheet feed control (Part 2).

Figure 18:
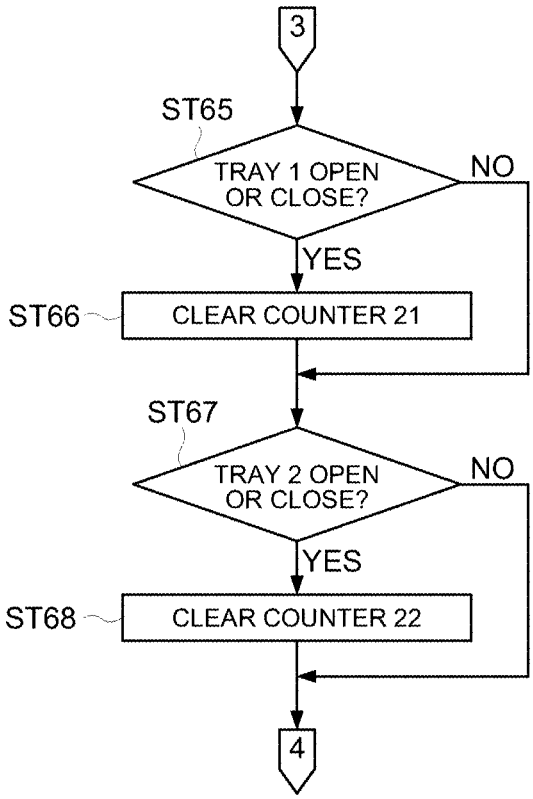

FIG. 18 is a flow chart showing an example of automatic sheet-turning inside out sheet feed control (Part 3).

Figure 19A:
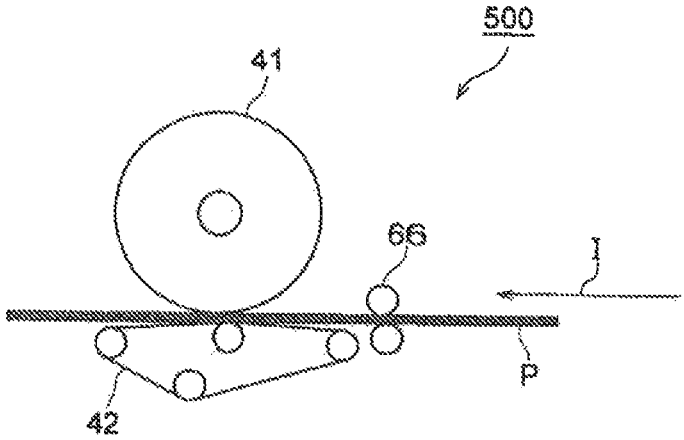
FIG. 19A PRIOR ART
Figure 19B:
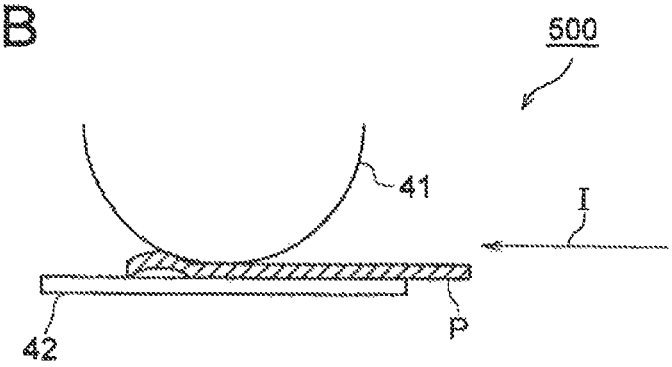
FIG. 19B PRIOR ART
Figure 19C:
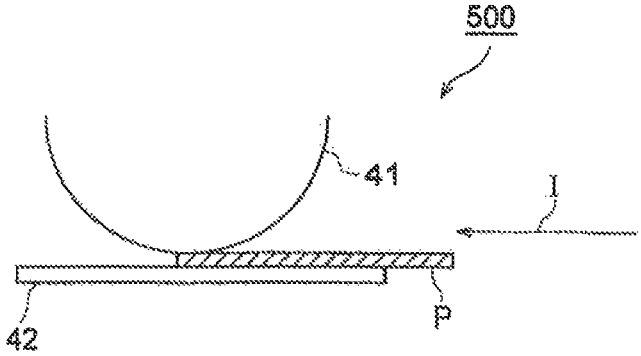
FIG. 19C PRIOR ART

Each of FIGS. 19A-19C is an illustration showing image forming apparatus 500 relating to a traditional example and an example of transfer for sheet P.

Figure 20A:
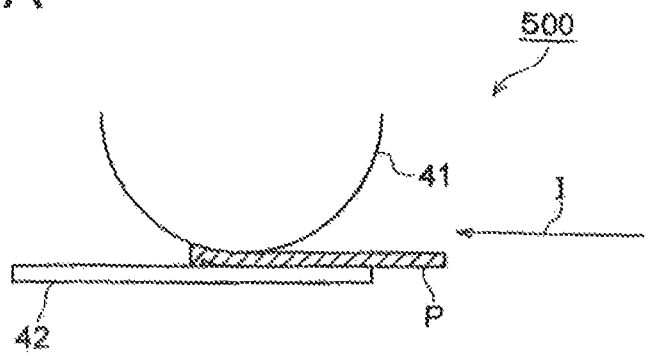
FIG. 20A PRIOR ART
Figure 20B:
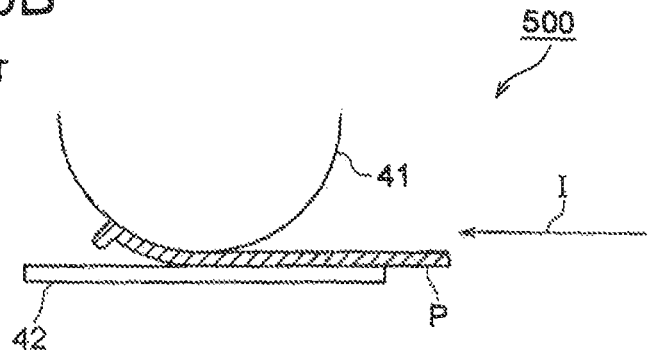
FIG. 20B PRIOR ART
Figure 20C:
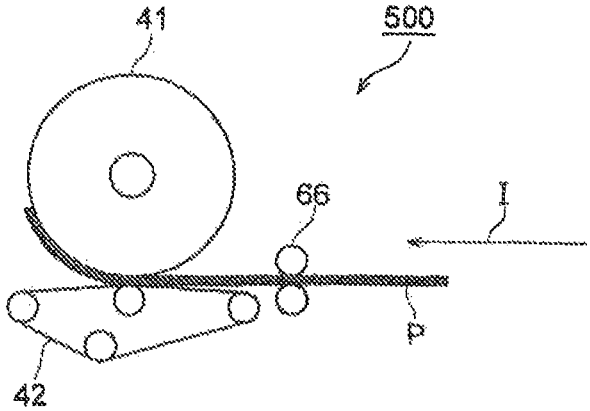
FIG. 20C PRIOR ART

Each of FIGS. 20A-20C is an illustration showing an example of winding of sheet P.

DETAILED DESCRIPTION OF THE PREFERRED EMBODIMENT

An image forming apparatus and a sensor control device both relating to an embodiment of the invention will be explained as follows, referring to the drawings.

First Embodiment

Figure 1:
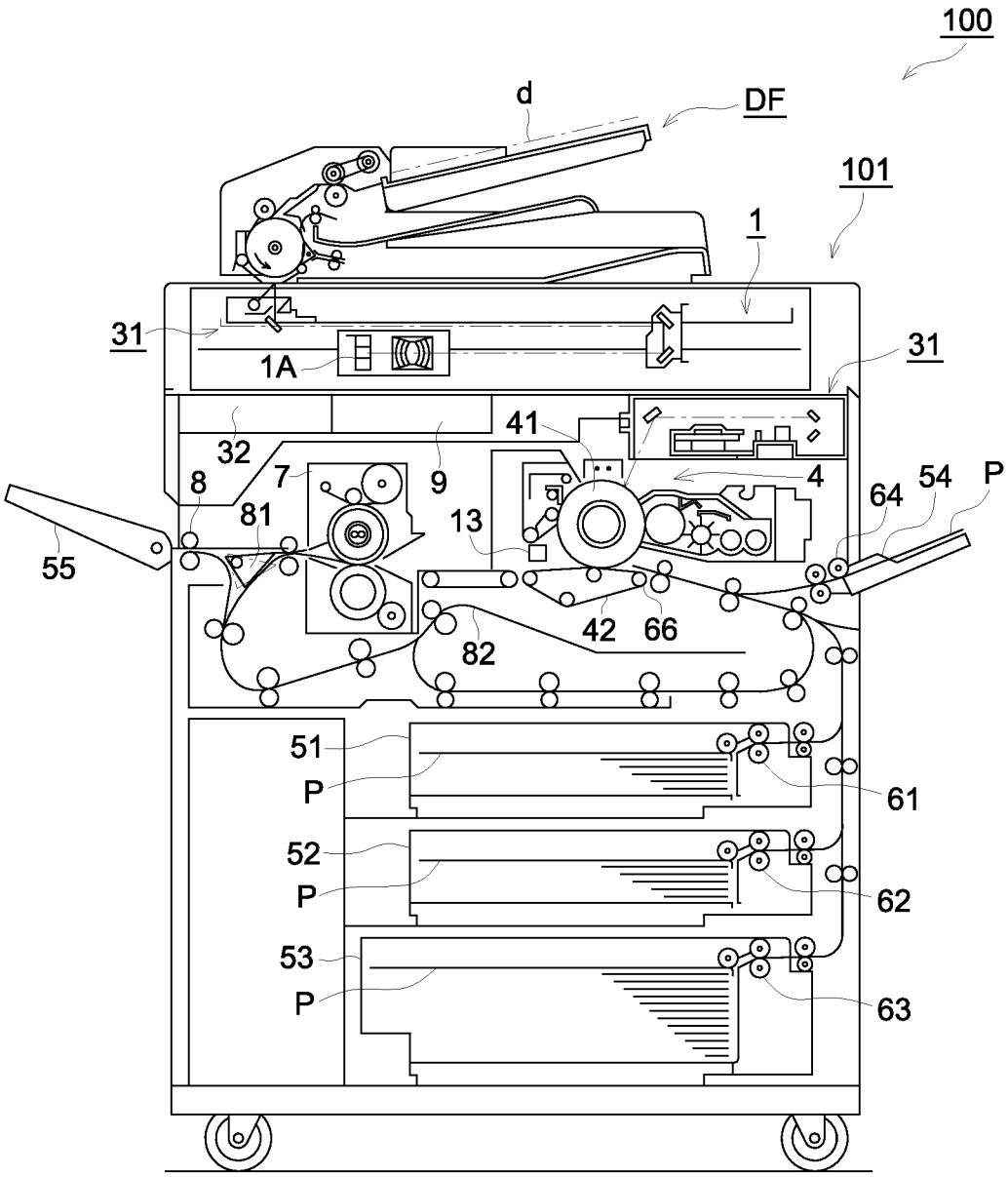
FIG. 1 is an illustration showing an example of structure of copying machine 100 representing the first embodiment.

Copying machine 100 shown in FIG. 1 is one constituting an example of an image forming apparatus, and for example, it is one for forming an image on prescribed sheet P based on image data obtained from document "d" through reading. The copying machine 100 has apparatus main body section 101. On the apparatus main body section 101, there are provided image writing section 30, image forming section 4, image reading section 31, image processing section 32, sheet feed cassettes 51, 52 and 53, manual sheet feeding tray 54, sheet ejection tray 55, first sheet feed sections 61, 62, 63 and 64, second sheet feed section 66, fixing device 7, sheet ejection section 8, automatic duplex copying sheet feed section (ADU) 82 and operation and display section 9.

Figure 2:
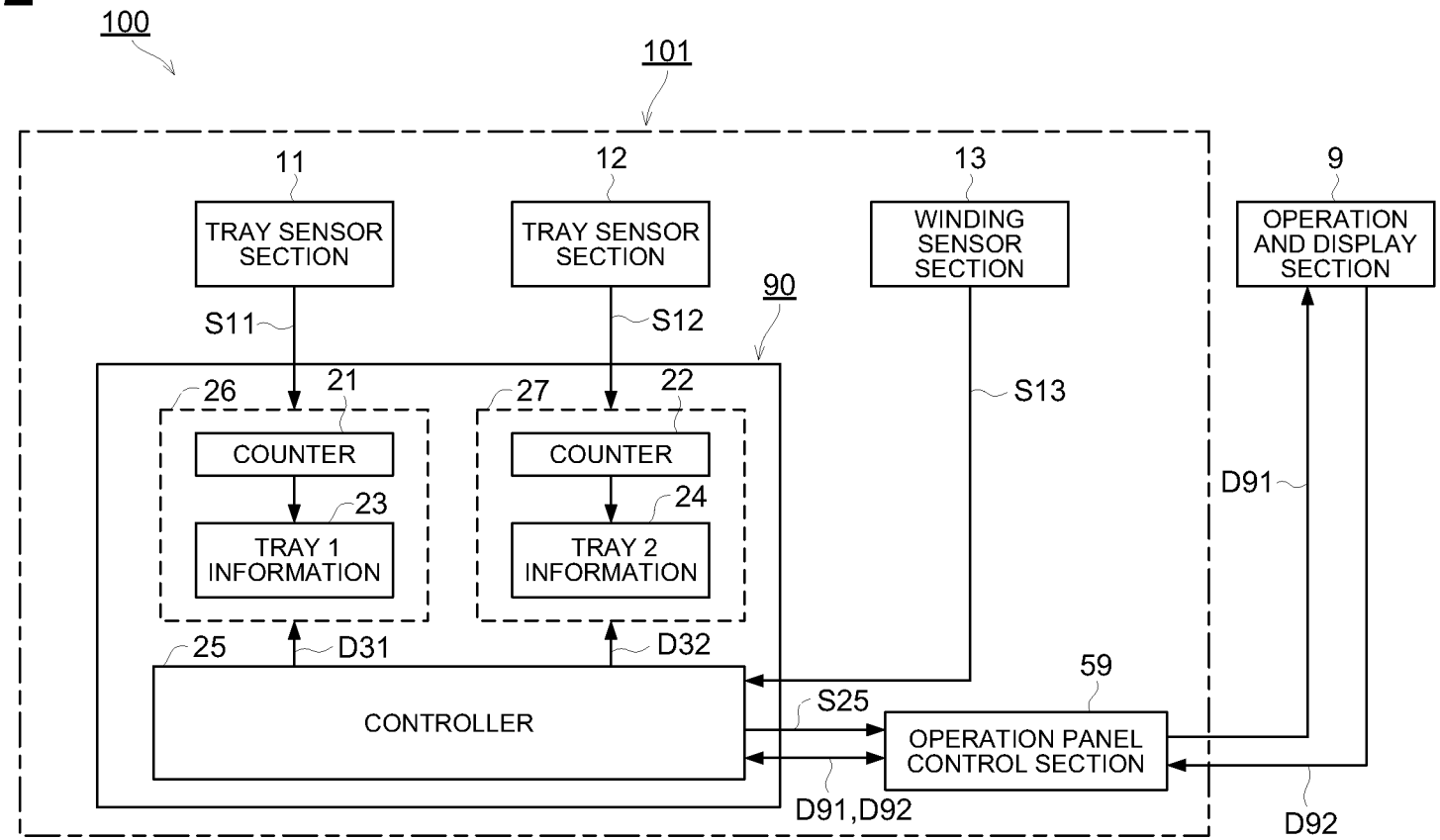
FIG. 2 is a block diagram showing an example of structure of a control system of copying machine 100.

The image reading section 31 reads images by giving scanning exposure to document "d", and outputs image data D1 (see FIG. 2). A scanner is used for image reading section 31. Image data D1 also include image signals coming from personal computers, external signals coming from a network and image signals coming from a facsimile machine which have experienced digital processing, in addition to image data obtained from the image reading section 31.

Automatic document feeder DF is mounted on the upper portion of apparatus main body section 101. Document "d" placed on a document table of the automatic document feeder DF is conveyed in the direction of an arrow, so that images on one side or on both sides of the document "d" are read by an optical system of the image reading section 31 to be read in image sensor 1A that uses CCD (solid-state imaging device). Analog image sensor subjected to photoelectric conversion by image sensor 1A undergo analog processing, A/D conversion processing, shading correction processing and image compression processing in image processing section 32, to become image data which are forwarded to the image writing section 30.

In the image writing section 30, a laser output beam emitted from laser diode (LD) is irradiated on photoconductor drum 41 that constitutes an example of an image carrier, in image forming section 4, and an electrostatic latent image is formed. In the image forming section 4 that adjoins the image writing section 30, there are conducted processing operations for charging, exposure, developing, transfer, separation and cleaning, for forming an image on a prescribed surface of sheet P. On the lower portion of the photoconductor drum 41, there is provided transfer section 42. The transfer section 42 is composed, for example, of transfer belt 42*a* and of charging device 42*b*. The transfer belt 42*a* is charged to be on the potential that is opposite to that of photoconductor drum 41 through the charging device 42*b*.

In the present example, an explanation has been given about functions of image forming for a black-and-white use, with respect to image forming section 4. However, it is naturally possible to constitute image forming section 4 equipped with image forming functions for colors of a yellow (Y) color, a magenta (M) color, a cyan (C) color and a black (K) color.

On the lower portion of the image forming section 4, there are provided sheet feed cassettes 51-53 and first sheet feed sections 61-64 which constitute an example of a sheet conveyance section, so that sheep P may be conveyed to transfer section 42. The sheet feed cassettes 51-53 constitute an example of a storing member, and store sheets P aligned in the prescribed placing direction. Sheet feed cassette 51 corresponds to tray 1, and sheet feed cassette 52 corresponds to tray 2 as follows.

Manual sheet feeding tray 54 is provided on the side of right side in the illustration of apparatus main body section 101. Sheet P fed by first sheet feed sections 61 to 64 from sheet feed cassettes 51 to 53 or from the manual sheet feeding tray 54 is conveyed to transfer section 42 through receiving of sheet conveyance control by second sheet feed section 66 (registration roller or the like). Second sheet feed section 66 has a function to cause conveyance timing for sheet P to agree with an image transfer position. The transfer section 42 transfers a toner image formed on photoconductor drum 41 onto prescribed sheet P. For example, the transfer section 42 transfers (carries) an image onto a prescribed surface of sheet P which has been synchronized with conveyance timing.

Sheet P carrying an image is fixed by fixing device 7, and is ejected to sheet ejection tray 55 from sheet ejection section 8. On the downstream side of the fixing device 7, there are provided conveyance path switching plate 81 and automatic duplexing copying sheet feed section 82. The sheet P after fixing is fed into automatic duplexing copying sheet feed section 82 by conveyance path switching plate 81, before sheet ejection when a two-side printing mode is established, and sheet P is ejected to sheet ejection tray 55 from sheet ejection section 8 after sheet P whose one side has been processed was processed in terms of two-sided image processing in image forming section 4 again.

On the downstream side of photoconductor drum 41 in the present example, there is provided an optical sensor (hereinafter referred to as winding sensor section 13) representing an example of a winding detecting section. In this case, the downstream side of photoconductor drum 41 means the side where sheet P is ejected from the nip position when the side where sheet P enters the nip position is made to be the upstream side, under the standard of the nip position between the photoconductor drum 41 and a transfer belt of transfer section 42. The winding sensor section 13 detects whether sheet P to be conveyed to transfer section 42 by second sheet feed section 66 is wound around photoconductor drum 41 or not, and generates sheet winding detection signals S13.

Next, referring to FIG. 2, an example of structure of a control system for coping machine 100 will be explained. Copying machine 100 shown in FIG. 2 is composed of operation and display section 9 and of apparatus main body section 101. The operation and display section 9 constitutes an example of an operation section and a display section, and it is provided on the outer side of the apparatus main body section 101, such as, for example, on the top surface (operation surface) of apparatus main body section 101. Inside the apparatus main body section 101, there are provided tray sensor sections 11 and 12, winding sensor section 13, operation panel controller 59 and control unit 90.

The operation and display section 9 is operated so that image forming conditions such as image density, number of copies, sheet sizes, sheet types, basis weight and sheet feed cassette selection may be established. The operation and display section 9 outputs operation data D92 to operation panel controller 59 of control unit 90, or, it inputs display data D91 from operation panel controller 59.

The operation data D92 are data for instructing a selection of sheet feed cassette, concerning, for example, sheet P on which an image is formed by image forming section 4. Further, the operation data D92 are data based on front and back sides designation for sheet P established in operation section 92. The display data 91 are data for displaying, for example, a basic established screen, a tray selection screen, an established menu screen, an operator establishing screen and a copy establishing screen (unillustrated). For the operation and display section 9, there are used inputting tools such as a liquid crystal display device, a touch panel and numeric keys.

In the present example, an image that urges a change of the placing direction for sheet P based on the display data D91 is displayed on a tray selection screen. For example, there is displayed character information such as "turn sheets in tray 1 inside out, and place again" (see FIG. 3). In this example, the aforesaid display of the character information is terminated when the tray 1 (sheet feed cassette 51) is placed again.

The operation and display section 9 is connected to operation panel controller 59. The operation panel controller 59 controls input and output of the operation and display section 9 based on operation panel control signal S25. For example, the operation panel controller 59 inputs operation data D92 from operation and display section 9, to transfer to controller 25. Further, the operation panel controller 59 inputs display data D91 from controller 25 to transfer them to the operation and display section 9. Operation panel control signals S25 are outputted to the operation panel controller 59 from controller 25. For example, the controller 25 displays an image that urges placing of sheet-turning inside out or placing of conveyance direction reversing for an operator of sheet P stored inside sheet feed cassette 51, therefore, it becomes possible to confirm the indication of the sheet-turning inside out placing or the conveyance direction reversing placing for the sheet P stored inside the sheet feed cassette 51.

On the other hand, tray sensor section 11 is provided on sheet feed cassette 51 shown in FIG. 1. The tray sensor section 11 generates tray set signal S11 by detecting that sheets P are stored (are set) in sheet feed cassette 51 or that the sheet feed cassette 51 is drawn out. For example, when tray set signal S11 is at a high level, it becomes a signal showing the state of sheet p set, while when it is at a low level, it becomes a signal showing the state of non-set.

Tray sensor section 12 is provided on sheet feed cassette 52 shown in FIG. 1. The Tray sensor section 12 generates tray set signal S12 by detecting that sheets P are stored (are set) in sheet feed cassette 52 or that the tray 2 is drawn out. For example, tray set signal S12 becomes a signal showing the state of sheet P set at a high level, and becomes a signal showing the state of sheet non-set at a low level. Tray 3 sensor section is provided on sheet cassette 53 shown in FIG. 1, which is not illustrated.

Winding sensor section 13 detects whether sheet P to be conveyed to transfer section 42 shown in FIG. 1 winds itself around photoconductor drum 41 or not, and it outputs detection signals S13 for sheet winding to controller 25. For the aforesaid tray sensor section 11, tray sensor section 12 and winding sensor section 13, there are used optical sensors of a reflection type and a transmission type.

Control unit 90 is composed of controller 25 and of data processing sections 26 and 27. The controller 25 is connected to winding sensor section 13 and to data processing sections 26 and 27. In the case of conveying sheet P to be fed out of sheet feed cassette 51 (tray 1) or of sheet feed cassette 52 (tray 2), the controller 25 inputs sheet winding detection signals S13 from winding sensor section 13, then, it processes sheet winding detection signals S13 on an analog-digital basis, and generates data showing the number of times of jam occurrence (hereinafter referred to as jam occurrence data D31 or D32). A central processing unit (CPU) is used as the controller 25.

Jam occurrence data D31 shows an accumulated number of times of winding of sheet P fed out of sheet feed cassette 51 around photoreceptor drum 41 (hereinafter referred to number of times of jam occurrence). The jam occurrence data D31 are outputted to data processing section 26, corresponding to sheet feed cassette 51. Further, jam occurrence data D32 shows an accumulated number of times of winding of sheet P fed out of sheet feed cassette 52 around photoreceptor drum 41 (hereinafter referred to as the number of times of jam occurrence). The jam occurrence data D32 are outputted to data processing section 27, corresponding to sheet feed cassette 52.

The aforesaid tray sensor section 11 is connected to data processing section 26 for tray 1. The data processing section 26 is composed of counter 21 and memory 23 for tray 1 information. The counter 21 counts the number of times of jam occurrence for sheet P that is fed out of sheet feed cassette 51. Jam occurrence data D31 showing the number of times of jam occurrence relating to tray 1 of sheet P are outputted from controller 25 to the counter 21 and the memory 23. On the memory 23, hysteresis data including tray 1 information are recorded as hysteresis of winding for sheet P of tray 1. The tray 1 information includes tray set information showing that sheet P has been stored in sheet feed cassette 51 and jam occurrence data D31 of sheet P fed out of sheet feed cassette 51.

Tray sensor section 12 is connected to data processing section 27 for tray 2. The data processing section 27 is composed of counter 22 and memory 24 for tray 2 information. The counter 22 counts the number of times of jam occurrence for sheet P fed out of sheet feed cassette 52. Jam occurrence data D32 showing the number of times of jam occurrence relating to tray 2 of sheet P are outputted from controller 25 to the counter 22 and to the memory 24.

On the memory 24, there are recorded hysteresis data such as tray 2 information, as hysteresis of winding for sheet P of tray 2. The tray 2 information includes tray set information showing that sheet P has been stored in sheet feed cassette 52 and jam occurrence data D32 for sheet P fed out of sheet feed cassette 52. The purpose of preserving the aforesaid winding hysteresis is to judge sheet-turning inside out of sheet P under the state of winding around the drum in the controller 25, and thereby to be capable of executing instruction of establishment for sheet P.

The aforesaid controller 25 executes display control that urges a change of a placing direction of sheet P stored in sheet feed cassette 51, based on sheet winding detection signals S13 outputted from winding sensor section 13. For example, the controller 25 compares the number of times for generated jams of sheet P fed out of sheet feed cassette 51 and wound around photoconductor drum 41 with a reference number of times for comparison, and controls operation and display section 9 through operation panel controller 59 so that an image that urges sheet-turning inside out placing or conveyance direction reversing placing for sheet P stored in sheet feed cassette 51 may be displayed, when the number of times of jam occurrence exceeds a reference number of times for comparison.

This display control makes it possible to reduce sheet P winding phenomena which are caused by the direction of occurrence of burrs on a cut sheet (which are shown with Pb in FIGS. 4A-4B), and it makes it possible to reduce jam clearance operations for removing sheet P from photoconductor drum 41 as far as possible. Incidentally, the controller 25 detects operations for changing placing direction of sheet P stored in sheet feed cassette 51, and it resets counter 21 for returning the accumulated number of times to zero based on change operations detected in this case. If the counter 21 is controlled by the controller 25 in this way, it becomes possible to detect (watch) occurrence of jams based on sheet winding detection signals S13 which are obtained by detecting whether the sheet P has wound newly around photoconductor drum 41 or not.

In the case where plural sheet feed cassettes 51, 52 and 53 are naturally provided, the controller 25 accumulates the number of times for sheet P to wind around photoconductor drum 41 for each of sheet feed cassettes 51, 52 and 53, and detects operations for changing placing directions for sheet P stored in each of sheet feed cassettes 51, 52 and 53, and the number of times accumulated for each of cassettes 51, 52 and 53 based on the detected operations for the change is reset. This makes it possible to detect (watch) occurrence of jam for each of sheet feed cassettes 51, 52 and 53, based on sheet winding detection signals S13 obtained by detecting whether sheet P is wound around photoconductor drum 41 newly for each of sheet feed cassettes 51, 52 and 53, or not.

Figure 3:
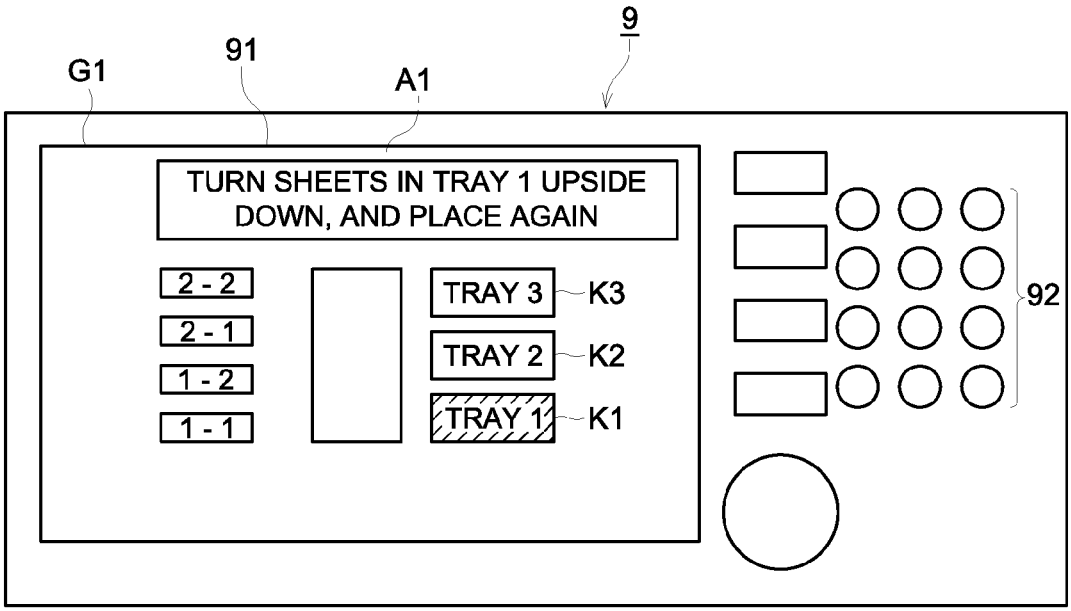
FIG. 3 is an illustration showing an example of display of tray selection screen G1 in operation and display section 9.

Next, an example of display on a tray selection screen in operation and display section 9 will be explained as follows, referring to FIG. 3. The operation and display section 9 shown in FIG. 3 is composed of display section 91 and of operation section 92. The operation section 92 is composed of inputting tools such as numeric keys and a push button. The operation section 92 is operated when designation for the inside and outside of sheet P and forward direction and backward direction of sheet P are registered.

The display section 91 is composed of a liquid crystal display device and of a touch panel, and it has a display screen having a prescribed size. On the display screen of the display section 91, there is displayed tray selection screen G1. On the tray selection screen G1, there are provided icon buttons K1, K2 and K3 corresponding respectively to message area A1, "Tray 1", "Tray 2" and "Tray 3". "Tray 1" corresponds to sheet feed cassette 51, "Tray 2" corresponds to sheet feed cassette 52 and "Tray 3" corresponds to sheet feed cassette 53.

On message area A1, there is displayed character information with an aim to indicate installment under sheet-turning inside out for sheet P, saying that "turn a sheet in tray 1 inside out, and set it again". This character information is displayed in the case when the number of winding jams of sheets from the same tray arrives at a fixed number of jam occurrence after tray setting, namely, in the case when the number of times of occurrence of jams winding around of photoconductor drum 41 of sheet P fed out of sheet feed cassette 51, exceeds a reference number of times for comparison in this example.

In that case, a display color of icon button K1 of "Tray 1" is changed to be different from other icon buttons K2 and K3 (that is shown to be a sandblast surface in the drawing). For example, the icon button K1 is displayed with a blue color on a white background, for the icon buttons K2 and K3 which are displayed with a black color on the white background. The display color is not limited to the aforesaid colors naturally, and it may also be a red color or a yellow color that can be distinguished from display colors of other icon buttons K2 and K3 and can call attention. Due to this, the controller 25 can execute an instruction to set up sheet P in each tray on a sheet-turning inside out basis, through display section 91.

Next, an example of transfer of sheet P will be explained as follows, referring to FIGS. 4A-4C. In the FIGS. 4A-4C, an arrow shows sheet feed direction I for sheet P. Sheet P shown in FIG. 4A is a cut sheet, and the diagram shows an occasion wherein burrs Pb (projections) which are pointing upward are caused on a cut surface of sheet P. Burrs Pb are those which appear as projections on the cut surface of sheet P after being cut, because force of pressing down is applied on a sheet under the condition that a cutting blade is pressed against the sheet in the fixed direction without a slicing motion, when a large-sized sheet such as, for example, a sheet in A2 size is to be used after being cut to a sheet in A3 size.

When these burrs Pb are pointing upward, a sheet winding phenomenon is not caused on photoconductor drum 41. The reason for this is as follows. Compared with an occasion shown in FIG. 20B, a clearance is caused between photoconductor drum 41 shown in FIG. 4B and sheet P. An electric discharge is caused continuously between sheet P and the transfer belt 42*a* side, thus, electric potential between sheet P and the photoconductor drum 41 is lowered, and adsorbing force between photoconductor drum 41 and sheet P is lowered, which makes it easy for sheet P to be separated from the photoconductor drum 41.

On the downstream side of photoconductor drum 41, shown in FIG. 4C, there is provided winding sensor section 13. The winding sensor section 13 operates to detect whether sheet P conveyed by second sheet feed section 66 to transfer section 42 has wound itself around photoconductor drum 41 or not. When burrs Pb are pointing upward, sheet P separated from photoconductor drum 41 passes through the lower part of winding sensor section 13, namely, it passes through the sensor area, a message saying that "Sheep P has been separated normally" is shown, for example, sheet winding detection signals S13 at a high level are outputted to controller 25.

In contrast to this, when burrs Pb are pointing downward (see FIG. 20A), a phenomenon that sheet P winds itself around photoconductor drum 41 without being separated from photoconductor drum 41 tends to occur, and sheet P passes through an upper part of winding sensor section 13, namely, it passes through a portion other than the sensor area, thus, a message saying that "Sheet P has wound itself around photoconductor drum 41" is shown, after a certain period of time, for example, sheet winding detection signals S13 at a low level are outputted to controller 25.

Next, an example of sheet-turning inside out of sheet P will be explained as follows, referring to FIGS. 5A-5C. Sheet P shown in FIG. 5A is a cut sheet, and the diagram shows an occasion wherein sheet P on which burrs Pb (not shown in FIG. 5A) are pointing toward the inner part side (back side) on the page is stored in an unillustrated sheet feed cassette. In this case, virtual character R is in the direction wherein the virtual character R described on sheet P can be read normally, for convenience sake.

In this example, when character information such as a message saying that "turn a sheet in tray 1 inside out, and place it again" is displayed on tray selection screen G1 shown in FIG. 3, sheet P shown in FIG. 5B is turned inside out by an operator. In FIG. 5B, an arrow represents direction II for sheet-turning inside out for sheet P. In this example, sheets are turned inside out by rotating a bundle of sheets P completely clockwise, with first sheet feeding section 61 (conveyance roller) for feeding out sheets that serves as a standard. It is naturally possible to rotate a bundle of sheets P counterclockwise for sheet-turning inside out.

Sheet P shown in FIG. 5C is in the state after the sheet-turning inside out. This is an occasion wherein burrs Pb on sheet P change their directions from the inner part side (backward) on the page of sheet P to this side (forward) on the page, and are stored in an unillustrated sheet feed cassette. In this case, virtual character R described on sheet P is in the direction in which the virtual character R described on sheet P cannot be read normally. By setting up sheet P on a sheet-turning inside out basis in the aforesaid way, burrs Pb change their direction to point upward (toward photoconductor 41 side), when sheet P arrives at photoconductor drum 41, and thus, a phenomenon of sheet winding shown in FIG. 20B is not caused.

Next, an example of display control for sheet-turning inside out of sheet P in copying machine 100 will be explained as follows, referring to FIGS. 6-8. The present embodiment shows an occasion wherein image forming section 4 forms an image on photoconductor drum 41, and transfer section 42 transfers an image formed on photoconductor drum 41 onto prescribed sheet P. In this case and in the occasion where sheet winding jam (JAM) caused by sheet feeding from the same sheet feed cassette 51, 52 or 53 is caused, the controller 25 detects winding of sheet P around photoconductor drum 41, and it controls hysteresis of winding for sheet P, thus, it executes control of display such as instructing setting up of sheet-turning inside out for sheet P based on the state of the winding hysteresis.

In this example, there is given an example of the occasion wherein character information of a message saying that "turn a sheet in tray 1 inside out and place again" is displayed on tray selection screen G1 of display section 91. The aforesaid hysteresis of winding around the drum is preserved for each tray such as tray 1 and tray 2. Incidentally, when sheet P whose front side and back side are designated is handled, and when winding around a drum is detected, an indication for sheet-turning inside out is not displayed.

With the foregoing serving as display control conditions, the controller 25 branches control corresponding to occurrence of winding jam around a drum, in step ST1 shown in FIG. 6. In this case, winding sensor 13 outputs low level sheet winding detection signals S13 to the controller 25, when sheet P conveyed by second sheet feed section 66 has wound around photoconductor drum 41.

When a jam winding around a drum is generated, the controller 25 that has moved to step ST2 and has inputted low level sheet winding detection signals S13 distinguishes a sheet whether the sheet P is from sheet feed cassette 51 or not, namely, whether tray 1 or not. A judgmental standard in this case is based on confirmation of input hysteresis of operation data D92 based on selection of tray 1 established by operation section 92.

When sheet P is a sheet coming from tray 1, a step moves to step ST3 and controller 25 carries out count-up (UP) for counter 21 shown in FIG. 2, and starts counting the number of times of drum winding jams (JAM) for tray 1. The number of times of drum winding jams (JAM) for tray 1 is recorded in memory 23 as winding hysteresis.

Then, a step moves to step ST4, and the controller 25 judges whether the number of times of occurrence of drum winding jams for tray 1 has exceeded the prescribed number of times or not. The controller 25 in this case compares a counted value on the counter 21 with a reference number of times for comparison, and forms a judgment with a standard whether the number of times of occurrence of drum winding jams for tray 1 has arrived at the prescribed number of times or not.

When the number of times for occurrence of winding jam around a drum for tray 1 has arrived at the prescribed number of times or more, a step moves to step ST5, and controller 25 branches the control, corresponding to presence or absence of front and back sides designation concerning to sheet P. The controller 25 at that time judges presence or absence of designation by confirming input hysteresis of operation data based on front and back sides designation concerning sheet P established in operation section 92.

When there is no front and back sides designation concerning sheet P, a step moves to step ST6 and controller 25 carries out display control for operation and display section 9, and displays character information of a message saying that "turn a sheet of tray 1 inside out, and place it again" for display section 91 shown in FIG. 3.

After that, a step moves to step ST7, and controller 25 waits for jam releasing. The jam releasing is conducted by an operator, and when operations of jam releasing are terminated, a step moves to step ST8 shown in FIG. 8, and controller 25 waits for detection of placing tray 1 again. In this case, if tray sensor section 11 detects placing sheet P again, tray set signals S11 are outputted to data processing section 26.

After that, in step ST9, the controller 25 terminates display of character information of a message say that "turn a sheet of tray 1 inside out, and place it again" in display section 91. Then, in step ST10, the controller 25 clears counter 21 to update the number of times for occurrence of winding jam around a drum for tray 1 to zero. Incidentally, it is possible either to execute display termination of character information in step ST9 and clearing of counter 21 in step ST10 at the same time, or to execute clearing of counter 21 first and then to terminate display of character information. After that, a step moves to step ST25.

In step ST4, when the number of times for occurrence of winding jam around a drum for tray 1 has not arrived at the prescribed number of times (less than the prescribed number of times), or when there is front and back sides designation concerning with sheet P in step ST5, a step moves to step ST11, and controller 25 waits for jam releasing. When jam releasing by an operator is terminated, a step moves to step ST25 shown in FIG. 8.

Further, in step ST2, the controller 25 distinguishes whether sheet P is coming from sheet feed cassette 52 or not, namely, whether sheet P is coming from tray 2 or not. In this case, the controller 25 judges a sheet feeder by confirming input hysteresis of operation data D92 based on selection of tray 2 established in operation section 92. When sheet P is a sheet fed from tray 2, a step moves to step ST12 shown in FIG. 7, and controller 25 counts up counter 22 to start counting the number of times for occurrence of winding jam around a drum for tray 2.

Then, a step moves to step ST 14, and controller 25 distinguishes whether the number of times for occurrence of winding jam around a drum for tray 2 exceeds the prescribed number of times or not. The controller 25, in this case, judges whether the number of times for occurrence of winding jam around a drum for tray 2 has arrived at the prescribed number of times or not, through a standard.

When the number of times for occurrence of winding jam around a drum for tray 2 has arrived at the prescribed number of times or more, a step moves to step ST14, and controller 25 branches control, corresponding to presence or absence of front and back sides designation concerning with sheet P. The controller 25 at that time judges presence or absence of designation by confirming input hysteresis of operation data D92 based on front and back sides designation concerning with sheet P established in operation section 92.

When there is no front and back sides designation relating to sheet P, a step moves to step ST15, and controller 25 controls the display for operation and display section 9, and displays character information of a message saying that "turn a sheet of tray 2 inside out, and place it again" on display section 91 shown in FIG. 3.

After that, a step moves to step ST16, and controller 25 waits jam releasing. When jam releasing operations by an operator are terminated, a step moves to step ST17, and the controller 25 waits detection for resetting of tray 1. In this case, tray sensor section 12 outputs tray set signals S12 to data processing section 27, after detecting resetting of sheet P.

After that, in step ST18, the controller 25 terminates display of character information of a message saying that "turn a sheet of tray 2 inside out, and place it again" on display section 91. Then, in step ST19, the controller 25 clears counter 22 to update the number of times for occurrence of winding jam around a drum for tray 2 to zero.

When the number of times for occurrence of winding jam around a drum for tray 2 is not arrived at the prescribed number (less than the prescribed number) in the aforesaid step ST13, and when there is front and back sides designation concerning sheet P in step ST14, a step moves to step ST20, and controller 25 waits jam releasing. When jam releasing operations are terminated by an operator, a step moves to step ST25 shown in FIG. 8.

Incidentally, when no jam of winding around a drum has occurred in step ST1, a step moves to step ST21 shown in FIG. 8, and controller 25 branches the control based on presence or absence of opening and closing of tray 1. In this case, when there are putting in and taking out of sheet feed cassette 51, and when tray set signals S11 showing existence of opening and closing of tray 1 are inputted from tray sensor section 11, a step moves to step ST22.

Then, in step ST22, the controller 25 clears counter 21 to update the number of times for occurrence of winding jam around a drum for tray 1 to zero. After that, a step moves to step ST23, and controller 25 branches the control based on presence or absence of opening and closing of tray 2. In this case when there are putting in and taking out of sheet feed cassette 52, and when tray set signals S12 showing existence of opening and closing of tray 2 are inputted from tray sensor section 12, a step moves to step ST24. In step ST24, the controller 25 clears counter 22 to update the number of times for occurrence of winding jam around a drum for tray 2 to zero. After that, a step moves to step ST25.

In step ST25, the controller 25 distinguishes a termination of sheet reversing display control. For the judgmental standard in this case, for example, the sheet reversing display control is distinguished whether it will be terminated or not by detecting power-off information. When the power-off information is not detected even when a prescribed period of time has elapsed, a step returns to step ST1, and the aforesaid control is repeated. When the power-off information is detected, the sheet reversing display control is terminated.

In copying machine 100 representing the first embodiment, there is equipped winding sensor section 13 that outputs sheet winding detection signals S13 to controller 25 by detecting whether sheet P conveyed by second sheet feed section 66 to transfer section 42 has wound around photoconductor drum 41 or not. The controller 25 executes display control that urges a change of the placing direction for sheet P stored in sheet feed cassette 51 based on sheet winding detection signals S13 outputted from winding sensor section 13.

Therefore, when sheet P winds itself around photoconductor drum for prescribed number of times, it becomes possible to display an image that urges a change of the placing direction for sheet P such as a message saying that "turn a sheet in tray 1 inside out, and place it again". Through this display, it becomes possible to confirm an indication for placing of sheet-turning inside out for sheet P stored in sheet feed cassette 51. Owing to this, it becomes possible to reduce phenomena of winding of sheet P around a drum caused by the direction of occurrence of burrs Pb on a cut sheet, and to reduce extremely jam clearance operations to remove sheet P wound around photoconductor drum 41.

Second Embodiment

Next, an example of arrangement and an example of functions for separation sensor section 14 representing the second embodiment will be explained as follows, referring to FIG. 9. Copying machine 100 shown in FIG. 9 is equipped with the separation sensor section 14 that constitutes an example of a sheet separation detecting section. The separation sensor section 14 observes (detects) separating functions of sheet P from photoconductor drum 41. Incidentally, explanations of those having the same symbols and names as those in the first embodiment will be omitted because they have the same functions.

In this example, the separation sensor section 14 is arranged at the position that is at the downstream side of transfer section 42 and is adjacent to transfer section 42 where sheet P is looked up. The separation sensor section 14 is connected to controller 25. The separation sensor section 14 detects sheet P separated from photoconductor drum 41, and outputs sheet separation detection signals S14 to controller 25. For the separation sensor section 14, focusing sensors capable of measuring a distance and a supersonic sensor are used.

FIG. 9 shows that the more the sheet P is lifted, the more the separating functions of the sheet P is worsened. The separating functions mentioned here means a degree for sheet P to be separated from photoconductor drum 41 easily. When burrs Pb on a cut sheet are facing upward, the separating functions are good, and when burrs Pb on a cut sheet are facing downward, in contrast to this, the separating functions are bad. In this case, when a distance between a position for mounting, the separation sensor section 14 and the leading edge of sheet P is made to be a sheet separation distance, the separation sensor section 14 generates sheet separation detection signals S14 corresponding to the sheet separation distance.

For example, when an unusual state of winding of sheet P around photoconductor drum 41 is detected, the separation sensor section 14 generates sheet separation detection signals S14 that shows sheet isolation distance "large" for the leading edge of sheet P that is lifted upward from the sheet feed direction I. Further, the separation sensor section 14 generates sheet separation detection signals S14 showing sheet isolation distance "small" for the leading edge of sheet P that is not lifted upward. Incidentally, when the intermediate state between the aforesaid two states is detected, sheet separation detection signals S14 showing sheet isolation distance "medium" is generated because the leading edge of sheet P is slightly lifted.

The controller 25 executes display control that urges a change of placing direction of sheet P stored in sheet feed cassette 51 explained in the first embodiment, based on sheet separation detection signals S14 outputted from the separation sensor section 14. For example, unusual state of winding of sheet P around photoconductor drum 41 is recognized by the controller 25, when sheet separation detection signals S14 showing sheet isolation distance "large" is detected. While when sheet separation detection signals S14 showing sheet isolation distance "small" keeps to be detected, the normal state of no winding of sheet P around photoconductor drum 41 is recognized. When sheet separation detection signals S14 showing sheet isolation distance "medium" starts to be detected, it becomes possible to recognize that there is a possibility for sheet P to be wound around photoconductor drum 41.

The controller 25 discriminates sheet isolation distances "large", "medium" and "small" by comparing the sheet separation detection signals S14 with threshold values for discriminating sheet isolation distances established in advance. When the number of times for detection of sheet isolation distance "large" exceeds the prescribed number of times, the controller 25 controls to display an image that urges a change of placing direction for sheet P such as a message saying that "turn a sheet of tray 1 inside out, and place it again". Due to this control, display section 91 displays a message saying that "turn a sheet of tray 1 inside out, and place it again" based on display data D91.

As stated above, in copying machine 100 representing a second embodiment, there is provided separation sensor section 14 that detects sheet P separated from photoconductor drum 41, and the controller 25 executes display control that urges a change of the placing direction of sheet P stored in sheet feed cassette 51 shown in FIG. 1 based on sheet separation detection signals S14 outputted from separation sensor section 14, thus, it is possible to display an image that urges a change of placing direction for sheet P such as a message saying that "turn a sheet of tray 1 inside out, and place it again", corresponding to the state for sheet P to be separated from photoconductor drum 41.

Through the display mentioned above, it becomes possible to confirm an instruction for placing of sheet-turning inside out or an instruction for placing of conveyance direction reversing for sheet P stored in sheet feed cassette 51. Owing to this, it becomes possible to reduce phenomena of winding of sheet P around a drum caused by the direction of occurrence of burrs Pb on a cut sheet, and to reduce extremely jam clearance operations to remove sheet P from photoconductor drum 41. Meanwhile, separation sensor section 14 can either be combined with copying machine 100 representing the first embodiment to be applied or be applied to copying machine 100 independently as in the Second Embodiment.

Third Embodiment

Next, an example of display for tray selection screen G1 in operation and display section 9 representing the third embodiment will be explained as follows, referring to FIG. 10. In this embodiment, in the case of handling sheet P for which front and back sides are designated like a coated paper, for example, and in the case of detecting winding around a drum, an instruction of conveyance direction reversing for sheet P is displayed.

"Conveyance direction reversing for the sheet" that has been mentioned above and will be mentioned from now on implies "conveyance direction reversing without conducting sheet-turning inside out".

Copying machine 100 shown in FIG. 10 is equipped with operation section 92. The operation section 92 is operated so that establishment of front and back sides designation for each of sheet feed cassettes 51, 52 and 53 shown in FIG. 1 may be registered on controller 25 through operation panel controller 59. The operation panel controller 59 displays an image that urges a conveyance direction reversing for sheet P stored in sheet feed cassette 51, on display section 91, when establishment of front and back sides designation for each sheet cassette 51 is registered by operation section 92 and when the accumulated number exceeds a reference number of times for comparison in the controller 25.

In this example, tray selection screen G1 is displayed on the display screen of display section 91 in the same way as in the first embodiment. On the tray selection screen G1, there are provided message area A1, and icon buttons K1, K2 and K3 corresponding respectively to "tray 1", "tray 2" and "tray 3". On the message area A1, there is displayed character information for indicating establishment of conveyance direction reversing for sheet P such as a message saying that "Reverse a conveyance direction of sheet and place it again".

This character information is displayed in the case when front and back sides establishment is registered, and in the case when the number of times of occurrence of winding jam for sheet feed from the same tray arrives at a fixed number of occurrence, including an example of the case when the number of occurrence of jam winding around photoconductor drum 41 for sheet P fed out of sheet feed cassette 51 exceeds a reference number of times for comparison. In that case, a display color of icon button K1 of "tray 1" has been changed (that is shown to be a sandblast surface in the drawing) to be different from those of other icon buttons K2 and K3, in the same way as in the first embodiment.

Next, an example of conveyance direction reversing for sheet P will be explained as follows, referring to FIGS. 11A-11C. Sheet P shown in FIG. 11A is a cut sheet that is represented by an occasion wherein burrs Pb on sheet P (that is not shown in FIG. 11A) faces the back on the page and is stored in an unillustrated sheet feed cassette. In this case, virtual character R described in sheet P is in the direction in which the virtual character R can be read normally for convenience sake.

In this example, when character information such as a message saying that "Reverse a conveyance direction of sheet of tray 1, and place it again" is displayed on tray selection screen G1, sheet P shown in FIG. 11B is reversed in terms of its direction. In FIG. 11B, an arrow represents direction III for conveyance direction reversing. In this example, a bundle of sheets is rotated counterclockwise by 180° for reversing the conveyance direction on the same plane, with conveyance roller 61 for feeding out a sheet serving as a standard. It is naturally possible to turn a bundle of sheets P clockwise for reversing the conveyance direction of the sheet.

Sheet P shown in FIG. 11C is in the state where the conveyance direction of the sheet P has been reversed. In that state, burrs Pb on the sheet P have changed their direction target from the upper side in the page to the lower side and are stored in an unillustrated sheet feed cassette. In this case, virtual character R described in sheet P is reversed and is in the direction in which the virtual character R cannot be read normally. By setting up the sheet P on the conveyance direction reversing basis as stated above, burrs Pb on sheet P can be positioned at the lower side on the trailing edge, which prevents occurrence of a phenomenon of sheet winding shown in FIG. 20B.

In the copying machine 100 representing the third embodiment, the controller 25 displays an image that urges placing of conveyance direction reversing of sheet P stored in sheet feed cassette 51 on the display section 91, in the case when front and back sides establishment for each of sheet feed cassettes 51, 52 and 53 shown in FIG. 1 is registered by operation section 92, and in the case when the number of times of jam occurrence exceeds a reference number of times for comparison.

Therefore, it becomes possible to confirm instructions for placing of conveyance direction reversing for sheet P stored in sheet feed cassette 51. Due to this, phenomena of winding of sheet P around a drum that is caused by the direction of occurrence of burrs Pb on a cut sheet can be reduced, and jam releasing operations to remove sheet P from photoconductor drum 41 can be reduced exceedingly.

Fourth Embodiment

Next, an example of conveyance direction reversing control for sheet P representing the fourth embodiment will be explained as follows, referring to FIGS. 12A-12C and FIGS. 13A-13C.

In this embodiment, there is sometimes an occasion wherein an image has been formed already on sheet P', and front and back sides designation for printing specific matters such as an address and a name, for example, at a prescribed position (follow printing) is in existence. In this case, the controller 25 executes instructions for conveyance direction reversing for sheet P' in tray 1 and executes control for direction reversing for print image.

On sheet P' for follow printing shown in FIG. 12A, a character image of "ABCD" is printed on the upper side on the right side of sheet P', for example, and a character image of "1234" is formed on the lower side on the left side. With respect to the direction of character image, when the specific matters such as an address and a name are printed, virtual character R is in the direction wherein the virtual character R can be read normally, for both character images.

Sheet P' for printing of this kind is stored in sheet feed cassette 51 of copying machine 100 shown in FIG. 1, with conveyance roller 61 for sheet feeding out shown in FIG. 12B serving as a standard. In this example, when front and back sides establishment for sheet is registered through operation section 92 shown in FIG. 10, and when the number of times of occurrences of winding jams for sheet feed from the same tray after tray setting arrives at a fixed number of occurrences, a character information such as a message saying that "Reverse a conveyance direction of a sheet of tray 1, and place it again" is displayed on tray selection screen G1 shown in FIG. 10.

Therefore, an operator operates so that a leading edge in the conveyance direction of sheet P' shown in FIG. 12C may be reversed. In FIG. 12C, an arrow represents direction IV for conveyance direction reversing for sheet P'. In this example again a bundle of sheets P' is rotated counterclockwise for reversing the direction on the same plane, with conveyance roller 61 for feeding out a sheet serving as a standard. It is also possible to rotate a bundle of sheets P' clockwise naturally for conveyance direction reversing.

In this example, as shown in FIG. 13A, sheets P' which have been arranged to be reversed for character information of "ABCD" and character information of "1234" are stored again correctly in sheet feed cassette 51 of copying machine 100 shown in FIG. 1, with conveyance roller 61 for feeding out a sheet serving as a standard. Virtual character R shown in FIG. 13B is reversed. In the third embodiment, it was not necessary to reverse a position of an image itself because unfigured sheet P' was imagined. However, if no action is taken for sheet P' for follow printing, specific matters such as an address and a name cannot be read normally when these specific matters are printed.

In this example, controller 25 shown in FIG. 10 detects changing operations of conveyance direction reversing for sheet P' stored in sheet feed cassette 51 shown in FIG. 1, and a position of an image formed on photoconductor drum 41 is subjected to be reversed. Changing operations for conveyance direction reversing for sheets P' are detected based on tray set signals S11 outputted to control unit 90 from tray sensor section 11 shown in FIG. 1.

In an example shown in FIG. 13C, character image of "ABCD" and character image of "1234" are formed at the position where virtual character R subjected to be reversed can be read normally on sheet P' subjected to be reversed. For example, specific mattes such as an address and a name are written on a memory capable of developing image data for one page, to be developed, corresponding to sheets P' for printing on which character images of "1234" and "ABCD" are printed.

If there is no conveyance direction reversing, a position to start writing images is on the side where character information of "ABCD" is printed, and images of specific matters such as an address and a name are formed by starting from character starting section to the position of character termination. However, when conveyance direction reversing is conducted, a position to start writing images is on the side on which the character image of "1234" was printed, and images are formed by changing an order of reading for image data from a memory, like image forming to form images for specific matters of an address and a name from a character termination section to a character starting position.

In copying machine 100 representing the fourth embodiment, the controller 25 detects the changing operations of conveyance direction reversing for sheet P' stored in sheet feed cassette 51 and conducts conveyance reversing for a position of an image formed on photoconductor drum 41 based on the changing operations thus detected. Therefore, even when establishment for front and back sides is registered, it is possible to make a position of the image to agree with a position before the conveyance direction reversing.

Meanwhile, when handling sheet P for which front and back sides are designated and conveyance direction reversing is designated, and when winding around a drum is detected, neither instruction for sheet-turning inside out for sheep P nor instruction for conveyance direction reversing for sheep P is displayed. The reason for this is because of extremely small possibility of jam occurrence.

Fifth Embodiment

Next, an example of constitution of image forming system #1 representing the fifth embodiment will be explained as follows, referring to FIG. 14. Image forming system #1 shown in FIG. 14 is composed of copying machine 200 and of large-capacity sheet feed device 300, and an image is formed on sheet P that is fed from the sheet feed device 300. The copying machine 200 has therein image forming section 4, controller 25 and sheet feed controller 75. The image forming section 4 has therein photoconductor drum 41 and transfer section 42, and forms an image on the photoconductor drum 41. The transfer section 42 transfers an image formed on the photoconductor drum 41 onto prescribed sheet P.

In this example again, winding sensor section 13 is provided on the downstream side of the transfer section 42. The winding sensor section 13 detects whether sheet P conveyed to the transfer section 42 by the sheet feed device 300 has wound itself around the photoconductor drum 41 or not, and it outputs sheet winding detection signals S13 to the controller 25. The controller 25 executes sheet turning conveyance control that turns over the conveyance direction for sheet P stored in sheet feed cassette 401, based on sheet winding detection signals S13 obtained from the winding sensor section 13, which is different from the first to fourth embodiments. The sheet turning conveyance control is executed through sheet feed controller 75. Incidentally, explanations of those having the same symbols and names as those in the First Embodiment will be omitted because they have the same functions.

"Turning over the conveyance direction for a sheet" which has been described above or will be described from now on implies "Changing an end portion of a sheet positioned at the downstream side in the conveyance direction for the sheet".

The copying machine 200 is connected to the sheet feed device 300 that constitutes an example of a sheet conveyance section. The sheet feed device 300 has a function to be capable of sheet feeding by turning sheet P upside down automatically before image forming. The sheet feed device 300 has plural sheet feed cassettes (three sheet feed cassettes 401, 402 and 403 in this example) each storing large volumes of sheets P, and conveys sheet P to transfer section 42.

The sheet feed device 300 has conveyance paths 68*a*, 68*b* and 68C, sheet reversing and conveyance path 70 and conveyance path switching device 74*a*, in addition to sheet feed cassettes 401, 402 and 403. The sheet reversing and conveyance path 70 is composed of conveyance paths 68*b* and 68*c* and of conveyance path switching device 74*b*, and the conveyance paths 68*b* is used for both non-sheet-turning inside out and sheet-turning inside out. The conveyance path switching device 74*a* is provided at the position where conveyance paths 68*a* and 68*b* as well as common conveyance path 66*b* intersect, and control of switching conveyance paths is executed by an unillustrated solenoid (see FIG. 15).

The sheet feed cassette 401 is composed, for example, of first sheet feed section 65*a*, suction belt 67*a* and sheet placing movable table 69*a*. In the sheet feed device 300, the sheet reversing and conveyance path 70 is a portion where sheet-turning inside out is carried out for sheet P. Dotted lines in the drawing show straight sheet feed path V which is a movement of sheet P in the case of straight sheet feed control. The straight sheet feed control means the control wherein sheet P on the sheet placing movable table 69*a* of sheet feed cassette 401 is sucked by the suction belt 67*a*, then, the sucked sheet is fed to the conveyance path 68*a* through first sheet feed section 65*a* (conveyance roller), to be conveyed to second sheet feed section 66 (registration roller) from the conveyance path 68*a* through the common conveyance path 66*b*, without passing through sheet reversing and conveyance path 70.

One-dot chain lines in the drawing represent sheet-turning inside out sheet feed path VI which is a movement of sheet P in the case of sheet-turning inside out sheet feed control. The sheet-turning inside out sheet feed control implies the control wherein sheet P on the sheet placing movable table 69*a* of sheet feed cassette 401 is sucked by the suction belt 67*a*, then, the sucked sheet is fed to the conveyance path 68*a* through first sheet feed section 65*a* (conveyance roller), and it is caused to take a switchback course by passing through sheet reversing and conveyance path 70, to be fed to second sheet feed section 66 (registration roller) through conveyance path 68*b* and common conveyance path 66*b*.

The sheet feed cassette 402 is composed, for example, of first sheet feed section 65*b*, suction belt 67*b* and sheet placing movable table 69*b*. In the straight sheet feed control, sheet P on the sheet placing movable table 69*b* of sheet feed cassette 402 is sucked by the suction belt 67*b*, then, the sucked sheet P is fed out through the first sheet feed section 65*b* (conveyance roller) to second sheet feed section 66 (registration roller) through the common conveyance path 66*b*, without passing through sheet reversing and conveyance path 70.

In the sheet feed control for sheet-turning inside out, sheet P on the sheet placing movable table 69*b* of sheet feed cassette 402 is sucked by the suction belt 67*b*, and then, the sucked sheet is fed out to conveyance path 68*b* of sheet reversing and conveyance path 70 through the first sheet feed section 65*b* (conveyance roller), to be caused to take a switchback course to be conveyed to the second sheet feed section 66 (registration roller) through common conveyance path 66*b*.

Sheet feed cassette 403 is composed, for example, of first sheet feed section 65*c*, suction belt 67*c* and sheet placing movable table 69*c*. In the straight sheet feed control, sheet P on the sheet placing movable table 69*c* of sheet feed cassette 403 is sucked by the suction belt 67*c*, then, the sucked sheet P is fed out through the first sheet feed section 65*c* (conveyance roller) to second sheet feed section 66 (registration roller) through conveyance path 68*b* and the common conveyance path 66*b*, without passing through the conveyance path 68*c* of sheet reversing and conveyance path 70. Conveyance path switching device 74*b* is arranged between conveyance path 68*b* and conveyance path 68*c* on the downstream side of sheet feed cassette 403.

In the sheet feed control for sheet-turning inside out, sheet P on the sheet placing movable table 69*b* of sheet feed cassette 402 is sucked by the suction belt 67*b*, and then, the sucked sheet is fed out to conveyance path 68*c* of sheet reversing and conveyance path 70 through the first sheet feed section 65*b* (conveyance roller) and conveyance path switching device 74*b*, and it is caused to take a switchback course to be conveyed to the second sheet feed section 66 (registration roller) through conveyance path 68*b* and common conveyance path 66*b*.

The controller 25 inputs sheet winding detection signals S13, then, counts the sheet winding detection signals S13 to accumulate the number of times for occurrence of winding of sheet P around photoconductor drum 41. Then, the controller 25 compares the number of times thus accumulated with a reference number of times for comparison, and when the accumulated number of times exceeds the reference number of times for comparison, the controller 25 controls sheet reversing and conveyance path 70 so that the conveyance direction for sheet P conveyed from sheet feed cassette 401 may be reversed. The control of the sheet reversing and conveyance path 70 is carried out through sheet feed controller 75. Owing to this control, when the number of times for the sheet P to wind itself around photoconductor drum 41 arrives at a prescribed number of times, sheet-turning inside out is carried out automatically by the sheet reversing and conveyance path 70 for sheet P fed out of sheet feed cassette 401, thus, sheets can be fed to transfer section 42 (sheet reversing and conveyance control).

Next, an example of constitution of a control system of copying machine 200 will be explained as follows, referring to FIG. 15. The copying machine 200 shown in FIG. 15 is composed of apparatus main body 102. Inside the apparatus main body 102, there are provided tray sensor sections 11 and 12, winding sensor section 13, sheet feed controller 75 and control unit 90. Explanations for items in this example having the same symbols and names as those in the first embodiment will be omitted because they have the same functions.

The sheet feed controller 75 is connected to the controller 25 and to the sheet feed device 300. The sheet feed device 300 has therein motors 71 and 72 and solenoid 73. The sheet feed controller 75 controls input and output of the sheet feed device 300 based on sheet feed control data D75. For example, the sheet feed controller 75 controls motors 71 and 72 and solenoid 73, based on sheet feed control data D75. The sheet feed control data D75 are outputted from controller 25 to the sheet feed controller 75. The sheet feed controller 75 generates motor control signals S71 and S72 and solenoid control signals S73, by decoding, for example, sheet feed control data D75.

Based on motor control signals S71, the motor 71 conveys sheet P as shown on straight sheet feed path V. The solenoid 73 controls conveyance path switching device 74*a* provided on this side of 70, based on solenoid control signals S73. For example, when sheet feed cassette 401 is selected and when straight sheet feed control is carried out, conveyance path switching device 74*a* is driven because solenoid 73 makes sheet reversing and conveyance path 70 to be non-selection based on solenoid control signals S73, to switch conveyance path 68*a* to be connected to common conveyance path 66*b*.

Motor 71 rotates in the prescribed direction based on motor control signals S71, and when sheet P on the sheet placing movable table 69*a* of sheet feed cassette 401 shown in FIG. 14 is sucked by the suction belt 67*a*, operations are made so that the sucked sheet is fed to conveyance path 68*a* through first sheet feed section 65*a* (conveyance roller), to be conveyed to second sheet feed section 66 (registration roller) from the conveyance path 68*a* through common conveyance path 66*b*.

Further, when sheet feed cassette 401 is selected, and when sheet-turning inside out sheet feed control is executed, solenoid 73 drives conveyance path switching device 74*a* for selecting sheet reversing and conveyance path 70 based on solenoid control signals S73, and switches conveyance path 68*a* so that it may be connected to conveyance path 68*b*. Motor 72 rotates to reverse the conveyance direction for sheet P based on motor control signals S72, for the purpose of switchback of sheet P conveyed through sheet reversing and conveyance path 70 by motor 71. Owing to this, it becomes possible to convey sheet P on a switchback basis by utilizing the sheet reversing and conveyance path 70 as shown by sheet-turning inside out sheet feed path VI.

On the other hand, tray sensor section 11 is provided on sheet feed cassette 401 shown in FIG. 14. The tray sensor section 11 generates tray set signals S11 by detecting that sheets P have been stored (set) in sheet feed cassette 401, or by detecting that the sheet feed cassette 401 has been drawn out.

Tray sensor section 12 is provided on sheet feed cassette 402 shown in FIG. 14. The tray sensor section 12 generates tray set signals S12 by detecting that the sheet P has been stored (set) in sheet feed cassette 402 or that the sheet feed cassette 402 has been drawn out. A sensor section for tray 3 is provided on sheet feed cassette 403 shown in FIG. 14, though this is not illustrated.

Winding sensor section 13 detects whether sheet P to be conveyed to transfer section 42 shown in FIG. 14 has wound itself around photoconductor drum 41 or not, and outputs sheet winding detection signals S13 to controller 25. An optical sensor of a reflection type or an optical sensor of a transmission type is used for the aforesaid tray sensor section 11, tray sensor section 12 and winding sensor section 13.

Control unit 90 is composed of controller 25 and data processing sections 26 and 27. The controller 25 is connected to winding sensor section 13 and to data processing sections 26 and 27. The controller 25 inputs sheet winding detection signals S13 from winding sensor section 13 when sheet P that is fed out of sheet feed cassette 401 or sheet feed cassette 402 is conveyed, and generates data showing the number of times of jam occurrence (hereinafter called jam occurrence data D31 or D32) by processing sheet winding detection signals S13 on an analog-to-digital basis. A central processing unit (CPU) is used for the controller 25.

Jam occurrence data D31 shows an accumulated number of times for sheet P fed out of sheet feed cassette 401 to wind around photoconductor drum 41 (hereinafter called a number of times for jam occurrence). Jam occurrence data D31 are outputted to data processing section 26 corresponding to sheet feed cassette 401. Further, jam occurrence data D32 show an accumulated number of times for sheet P fed out of sheet feed cassette 402 to wind around photoconductor drum 41 (hereinafter called a number of times for jam occurrence). Jam occurrence data D32 are outputted to data processing section 27 corresponding to sheet feed cassette 402.

The aforesaid tray sensor section 11 is connected to data processing section 26 for fray 1. The data processing section 26 is composed of counter 21 and memory 23 for tray 1 information. The counter 21 counts the number of times for jam occurrence for sheets P fed out of sheet feed cassette 401. Jam occurrence data D31 showing the number of times for jam occurrence relating to tray 1 of sheet P are outputted to counter 21 and memory 23 from controller 25. On the memory 23, there are recorded hysteresis data such as tray 1 information. The tray 1 information includes tray set information showing that sheet P has been stored in sheet feed cassette 401 and jam occurrence data D31 for sheet P fed out of sheet feed cassette 401.

Tray sensor section 12 is connected to data processing section 27 for tray 2. The data processing section 27 is composed of counter 22 and memory 24 for tray 2 information. The counter 22 counts the number of times of jam occurrence for sheet P fed out of sheet feed cassette 402. Jam occurrence data D32 showing the number of times for jam occurrence relating to tray 2 of sheet P are outputted to counter 22 and memory 24 from controller 25. On the memory 24, there are recorded hysteresis data such as tray 2 information. The tray 2 information includes tray set information showing that sheet P has been stored in sheet feed cassette 402 and jam occurrence data D32 for sheet P fed out of sheet feed cassette 402.

The aforesaid controller 25 executes sheet-turning inside out sheet feed control for sheet P stored in sheet feed cassette 401, based on sheet winding detection signals S13 outputted from winding sensor section 13. For example, the aforesaid controller 25 compares the number of times of jam occurrence for sheet P fed out of sheet feed cassette 401 to wind around photoconductor drum 41 with a reference number of times for comparison, and executes the sheet-turning inside out sheet feed control for sheet P stored in sheet feed cassette 401 through sheet feed controller 75, when the number of times of jam occurrence exceeds the reference number of times for comparison.

Next, an example of automatic sheet-turning inside out sheet feed in image forming system #1 will be explained as follows, referring to FIGS. 16-18. In the present embodiment, winding of sheet P around photoconductor drum 41 is detected, hysteresis of winding of sheet P is managed and sheet-turning inside out sheet feed control for sheet P stored in sheet feed cassette 401 of sheet feed device 300 is executed based on the state of hysteresis of the winding.

In the present example, when sheet winding jams (JAM) exceeding a prescribed number of times have occurred in the case when tray 1 straight sheet feed control is selected under the condition that sheet feed cassette 401 is made to be tray 1 and sheet feed cassette 402 is made to be tray 2, tray 1 reversing sheet feed control is executed. In contrast to this, when sheet winding jams (JAM) exceeding a prescribed number of times have occurred in the case when tray 1 reversing sheet feed control is selected, tray 1 straight sheet feed control is executed, which is the same also for tray 2. Incidentally, when handling sheet P for which front and back sides are designated, there is given an example wherein sheet-turning inside out sheet feed control is not executed even when winding around a drum is detected.

Under the sheet feed control conditions represented by the foregoing, controller 25 of copying machine 200 branches the control in step ST31 shown in FIG. 16, corresponding to sheet feeding from tray 1 or to sheet feeding from tray 2. When sheet feeding from tray 1 is selected, a step moves to step ST32, and controller 25 branches the control corresponding to tray 1 straight sheet feed control or to tray 1 reversing sheet feed control. The sheet feed controller 75 inputs sheet feed control data D75 from controller 25, and executes tray 1 straight sheet feed control.

In the tray 1 straight sheet feed control, sheet P on sheet placing movable table 69*a* of sheet feed cassette 401 is sucked by suction belt 67*a*, and sheet P sucked on the suction belt is fed out to conveyance path 68*a* through first sheet feed section 65*a* (conveyance roller), and is conveyed to second sheet feed section 66 (registration roller) through common conveyance path 66*b* from the conveyance path 68*a*, without passing through sheet reversing and conveyance path 70.

When tray 1 straight sheet feed control is executed, a step moves to step ST33, and controller 25 branches the control corresponding to occurrence of jam winding around a drum of tray 1. In this case, when sheet P conveyed by the first sheet feed section 65*a* is wound around photoconductor drum 41, for example, winding sensor section 13 outputs low level sheet winding detection signals S13 to the controller 25.

Then, in step ST34, the controller 25 starts counting up counter 21 to count the number of times for winding jam (JAM) around a drum of tray 1. The number of occurrence for winding jam (JAM) around a drum of tray 1 is recorded on memory 23 as hysteresis of winding.

When the number of times for occurrence of jam of winding around a drum is counted, a step moves to step ST35, and controller 25 in which low level sheet winding detection signals S13 discriminates whether the number of times of occurrence of jams of winding around a drum exceeds the prescribed number of times or not. In this case, the controller 25 judges whether the number of times of occurrence of jam winding around a drum of tray 1 has arrived at a prescribed number of times or not, by comparing the counted value for counter 21 with a reference number of times for comparison.

When the number of times of occurrence of jam winding around a drum of tray 1 arrives at a prescribed number of times or more, a step moves to step ST36, and the controller 25 branches the control corresponding to presence or absence of designation of front and back sides relating to sheet P. In that case, the controller 25 judges by confirming input hysteresis of operation data D92 based on designation of front and back sides relating to sheet P established in operation section 92, as explained in the first embodiment.

When there is no designation of front and back sides relating to sheet P, a step moves to step ST37, and the controller 25 executes tray I sheet-turning inside out sheet feed control. Sheet feed controller 75 inputs sheet feed control data D75 from the controller 25, and executes tray 1 sheet-turning inside out sheet feed control. In the tray 1 sheet-turning inside out sheet feed control, sheet P on the sheet placing movable table 69*b* of sheet feed cassette 401 is sucked by the suction belt 67*a*, and sheet P sucked in this case is fed out to conveyance path 68*a* through first sheet feed section 65*a* (conveyance roller), and is caused to take a switchback course through sheet reversing and conveyance path 70 to be conveyed to second sheet feed section 66 (registration roller) through common conveyance path 66*b*.

After that, a step moves to step ST38, and the controller 25 clears counter 21, to update the number of times for occurrence of winding jam around a drum for tray 1 to zero. After that, a step moves to step ST39, and jam releasing is waited. Jam releasing is carried out by an operator, and when jam releasing operations are terminated, a step moves to step ST69. In the releasing operations for winding jam, an operator opens an unillustrated front panel on the apparatus main body 101, and removes sheet P that is wound around photoconductor drum 41.

Incidentally, in the aforesaid step ST35, when the number of times of occurrence of jam winding around a drum of tray 1 has not arrived at a prescribed number of times (less than the prescribed number of times) and when there is designation of front and back sides, a step moves to step ST40, controller 25 waits jam releasing. When operations of jam releasing are terminated by an operator, a step moves to step ST69. Further, when sheet P is not wound around photoconductor drum 41 in step ST33, a step moves to ST69.

Further, when fray 1 straight sheet feed control is not selected in step ST32 but tray 1 reversing sheet feed control is selected, a step moves to step ST41, and tray 1 reversing sheet feed control is executed. Sheet feed controller 75 executes tray 1 sheet-turning inside out sheet feed control by inputting sheet feed control data D75 from controller 25. In tray 1 sheet-turning inside out sheet feed control, sheet P on sheet placing movable table 69*a* of sheet feed cassette 401 is sucked by suction belt 67*a*, and the sheet P thus sucked is fed out to conveyance path 68*a* through first sheet feed section 65*a* (conveyance roller), then, the sheet P is caused to take a switchback course through sheet reversing and conveyance path 70, to be fed to the second sheet feed section 66 (registration roller) through conveyance path 68*b* and common conveyance path 66*b*.

Then, in step ST42, the controller 25 branches the control corresponding to occurrence of jam winding around a drum of tray 1. In this case, when sheet P conveyed by the first sheet feed section 65*a* is wound around photoconductor drum 41, for example, winding sensor section 13 outputs low level sheet winding detection signals S13 to the controller 25.

Then, in step ST43, the controller 25 starts counting up counter 21 to count the number of times of occurrence of jam (JAM) of winding around a drum of tray 1. The number of times of occurrence of jam (JAM) of winding around a drum of tray 1 is recorded on memory 23 as hysteresis of winding.

In the case of occurrence of a jam winding around a drum, a step moves to step ST44, and controller 25 that has inputted low level sheet winding detection signals S13 judges whether the number of times for occurrence of a jam winding around a drum has exceeded the prescribed number of times or not. In this case, the controller 25 compares a value of counting the counter 21 with a reference number of times for comparison to know whether the number of times of occurrence of jam of winding around a drum of tray 1 has arrived at a prescribed number of times or not, which is a standard for the judgment.

When the number of times of occurrence of jam of winding around a drum of tray 1 has arrived at the prescribed number of times or more, a step moves to step ST45, and the controller 25 executes tray 1 straight sheet feed control. Sheet feed controller 75 executes tray 1 straight sheet feed control by inputting sheet feed control data D75 from the controller 25 tray 1 straight sheet feed control. In the tray 1 straight sheet feed control, sheet P on the sheet placing movable table 69*a* of sheet feed cassette 401 is sucked by the suction belt 67*a*, then, the sucked sheet P is fed out to conveyance path 68*a* through the first sheet feed section 65*a* (conveyance roller), and it is conveyed from the conveyance path 68*a* to second sheet feed section 66 (registration roller) through the common conveyance path 66*b*, without passing through sheet reversing and conveyance path 70.

After that, a step moves to step ST46, and the controller 25 clears counter 21, to update the number of times for occurrence of winding jam around a drum for tray 1 to zero. After that, a step moves to step ST47, and jam releasing is waited. Jam releasing is carried out by an operator, and when jam releasing operations are terminated, a step moves to step ST69.

Further, when sheet feed from tray other than tray 1 is selected in the aforesaid step ST31, a step moves to step ST48 shown in FIG. 17, and the controller 25 judges whether sheet feed from tray 2 is selected or not. When the sheet feed from tray 2 is selected, a step moves to step ST49, and the controller 25 branches the control, corresponding to tray 2 straight sheet feed control or to tray 2 reversing sheet feed control. Sheet feed controller 75 inputs sheet feed control data D75 from the controller 25, and executes tray 2 straight sheet feed control. In tray 2 straight sheet feed control, sheet P on the sheet placing movable table 69*b* of sheet feed cassette 402 is sucked by the suction belt 67*b*, then, the sucked sheet P is fed out through the first sheet feed section 65*b* (conveyance roller), and it is conveyed from the conveyance path 68*b* to second sheet feed section 66 (registration roller) through the common conveyance path 66*b*, without passing through sheet reversing and conveyance path 70.

When the tray 2 straight sheet feed control is selected, a step moves to step ST50, and the controller 25 branches the control, corresponding to occurrence of jam winding around a drum for tray 2. In this case, winding sensor section 13 outputs low level sheet winding detection signals S13 to the controller 25, when sheet P conveyed by the first sheet feed section 65*b* winds itself around photoconductor drum 41, for example.

Then, in step ST51, the controller 25 starts counting up counter 22 to count the number of times for occurrence of jam (JAM) of winding around a drum of tray 2. The number of times for occurrence of jam (JAM) of winding around a drum of tray 2 is recorded on memory 24 as hysteresis of winding.

When jam of winding around a drum occurs, a step moves to step ST52, the controller 25 that has inputted low level sheet winding detection signals S13 judges whether the number of times for occurrence of jam of winding around a drum has exceeded the prescribed number of times. In this case, the controller 25 compares a value of counting the counter 22 with a reference number of times for comparison to know whether the number of times of occurrence of jam of winding around a drum of tray 2 has arrived at a prescribed number of times or not, which is a standard for the judgment.

When the number of times for occurrence of jam of winding around a drum of tray 2 arrives as the prescribed number of times or more, a step moves to step ST53, and the controller 25 branches the control, corresponding to presence or absence of front and back sides designation concerning to sheet P. The controller 25 at that time judges by confirming input hysteresis of operation data D92 based on designation for front and back sides relating to sheet P established in operation section 92, as explained in the first embodiment.

When there is no designation of front and back sides concerning sheet P, a step moves to step ST54, and the controller 25 executes tray 2 sheet-turning inside out sheet feed control. Sheet feed controller 75 inputs sheet feed control data D75 from the controller 25, and executes tray 2 sheet-turning inside out sheet feed control. In tray 2 sheet-turning inside out sheet feed control, sheet P on the sheet placing movable table 69*b* of sheet feed cassette 402 is sucked by the suction belt 67*b*, then, the sucked sheet P is fed out to conveyance path 68*b* through the first sheet feed section 65*b* (conveyance roller), and it is caused to take a switchback course through sheet reversing and conveyance path 70 to be conveyed to second sheet feed section 66 (registration roller) through the conveyance path 68*b* and the common conveyance path 66*b*.

After that, a step moves to step ST55, and the controller 25 clears counter 22 to update the number of times for occurrence of jam winding around a drum for tray 2 to zero. Then, a step moves to step ST56 to wait jam releasing. Jam releasing is carried out by an operator, and when jam releasing operations are terminated, a step moves to step ST69. In operations of releasing wound jam, an operator opens an unillustrated front panel on the apparatus main body 101 and removes sheet P that is wound around photoconductor drum.

Meanwhile, when the number of times for occurrence of winding jam around a drum for tray 2 has not arrived at the prescribed number (less than the prescribed number) in the aforesaid step ST52, and when there is designation of front and back sides concerning sheet P in step ST53, a step moves to step ST57, and the controller 25 waits jam releasing. When operations of jam releasing are terminated by an operator, a step moves to step ST69.

Further, when tray 2 straight sheet feed control is not selected but tray 2 sheet-turning inside out sheet feed control is selected in step ST49, a step moves to step ST58, and tray 2 sheet-turning inside out is executed. Sheet feed controller 75 inputs sheet feed control data D75 from controller 25, and executes tray 2 sheet-turning inside out sheet feed control. In tray 2 sheet-turning inside out sheet feed control, sheet P on the sheet placing movable table 69*b* of sheet feed cassette 402 is sucked by the suction belt 67*b*, then, the sucked sheet P is fed out to conveyance path 68*b* through the first sheet feed section 65*b* (conveyance roller), and it is caused to take a switchback course through sheet reversing and conveyance path 70 to be conveyed to second sheet feed section 66 (registration roller) through the conveyance path 68*b* and the common conveyance path 66*b*.

Then, in step ST59, the controller 25 branches the control corresponding to occurrence of jam winding around a drum of tray 2. In this case, when sheet P conveyed by the first sheet feed section 65*b* is wound around photoconductor drum 41, for example, winding sensor section 13 outputs low level sheet winding detection signals S13 to the controller 25.

Then, in step ST60, the controller 25 starts counting up counter 22 to count the number of times of occurrence of jam (JAM) of winding around a drum of tray 2. The number of times of occurrence of jam (JAM) of winding around a drum of tray 2 is recorded on memory 24 as hysteresis of winding.

In the case of occurrence of a jam winding around a drum, a step moves to step ST61, and controller 25 that has inputted low level sheet winding detection signals S13 judges whether the number of times for occurrence of a jam winding around a drum has exceeded the prescribed number of times or not. In this case, the controller 25 compares a value of counting the counter 22 with a reference number of times for comparison to know whether the number of times of occurrence of jam of winding around a drum of tray 2 has arrived at a prescribed number of times or not, which is a standard for the judgment.

When the number of times for occurrence of jam of winding around a drum of tray 2 has arrived at the prescribed number of times or more, a step moves to step ST62, and the controller 25 executes tray 2 straight sheet feed control. Sheet feed controller 75 executes tray 2 straight sheet feed control by inputting sheet feed control data D75 from the controller 25. In the tray 2 straight sheet feed control, sheet P on the sheet placing movable table 69*b* of sheet feed cassette 402 is sucked by the suction belt 67*b*, then, the sucked sheet P is fed out through the first sheet feed section 65*b* (conveyance roller), and it is conveyed from the conveyance path 68*a* to second sheet feed section 66 (registration roller) through the common conveyance path 66*b*, without passing through sheet reversing and conveyance path 70.

After that, a step moves to step ST63, and the controller 25 clears counter 22 to update the number of times for occurrence of jam winding around a drum for tray 2 to zero. After that, a step moves to step ST64 to wait jam releasing. Jam releasing is carried out by an operator, and when jam releasing operations are terminated, a step moves to step ST69.

When sheet feed from tray 2 is not selected in the aforesaid step ST48, a step moves to step ST65 shown in FIG. 18, and controller 25 branches the control based on presence or absence of opening and closing of tray 1. In this case, when there is putting in and taking out of sheet feed cassette 401, and when tray set signal S11 showing existence of opening and closing of tray 1 is inputted from tray sensor section 11, a step moves to step ST66.

In step ST66, the controller 25 clears counter 21 to update the number of times for occurrence of jam winding around a drum for tray 1 to zero. After that, a step moves to step ST67, and controller 25 branches the control based on presence or absence of opening and closing of tray 2. In this case, when there is putting in and taking out of sheet feed cassette 402, and when tray set signal S12 showing existence of opening and closing of tray 2 is inputted from tray sensor section 12, a step moves to step ST68. In step ST68, the controller 25 clears counter 22 to update the number of times for occurrence of jam winding around a drum for tray 2 to zero. After that, a step moves to step ST69.

In step ST69, controller 25 judges terminations of controls including tray 1 straight sheet feed control, tray 1 sheet-turning inside out sheet feed control, tray 2 straight sheet feed control, and tray 2 sheet-turning inside out sheet feed control. In this case, the controller 25 detects power-off information, for example, and judges under a standard whether the aforesaid sheet feed control can be terminated or not. When the power-off information is not detected even when a prescribed period of time has elapsed, a step moves to step ST31, and the aforesaid sheet feed control is repeated. When the power-off information is detected, the aforesaid sheet feed control is terminated.

In the image forming system #1 representing the fifth embodiment as stated above, controller 25 of copying machine 200 executes, in the case of execution of tray 1 straight sheet feed control, the tray 1 sheet-turning inside out sheet feed control that reverses the conveyance direction for sheet P stored in sheet feed cassette 401, when the number of times equal to or more than a prescribed times for occurrence of jam winding around a drum is detected based on sheet winding detection signal S13.

Further, when the number of times for occurrence of jam winding around a drum that is equal to or more than a prescribed number of times is detected based on sheet winding detection signals S 13 outputted from winding sensor section 13, in the case of execution of tray 1 sheet-turning inside out sheet feed control, tray 1 straight sheet feed control that returns the conveyance direction for sheet P stored in sheet feed cassette 401 to the original direction is executed. The same also applies to tray 2 in the same way.

Therefore, when sheet P winds itself around photoconductor drum 41 for the prescribed number of times, the conveyance direction for sheet P fed out of sheet feed cassette 401 of sheet feed device 300 can be reversed automatically, or a sheet can be fed to transfer section 42 by returning the sheet feed direction to its original direction. This makes it possible to reduce phenomena of sheet P winding around a drum which are caused by the direction of occurrence of burrs Pb on a cut sheet, and to reduce jam clearance operations for removing sheet P from photoconductor drum 41 as far as possible.

Incidentally, even in copying machine 200, it is possible to cause the controller 25 to control sheet reversing and conveyance path 70 so that separation sensor section 14 explained in the second embodiment may be provided, and the conveyance direction for sheet P conveyed from sheet feed cassette 401 based on sheet separation detection signals S14 outputted from separation sensor section 14, is reversed, and the conveyance direction may be maintained as it is.

If the copying machine 200 is constituted as explained above, when sheet P winds itself around photoconductor drum 41 for the prescribed number of times, it is possible for the controller 25 to execute automatic sheet-turning inside out control for sheet P fed out of sheet feed cassette 401, or to execute display control of reversing placing in front and behind.

When transferring a toner image onto a cut paper, the present invention is extremely suitable when it is applied to a copying machine and a printer each being equipped with a function to execute sheet feed control, corresponding to hysteresis of the state of winding around the drum, because the state of winding of the sheet around the drum is watched.

An embodiment of the image forming apparatus is one equipped with a controller that executes a display control that urges a change of the placing direction for the sheet stored in the storing member, based on sheet winding detection signals outputted from the winding detecting section that detects whether the sheet has wound itself around an image carrier or not.

Since the constitution mentioned above makes it possible to indicate placing of sheet-turning inside out or placing of conveyance direction reversing for a sheet stored in a storing member, it becomes possible to reduce the number of phenomena of sheet winding around the image carrier caused by the direction of occurrence of burrs on a cut sheet, and to reduce extremely jam releasing operations for removing a sheet wound around an image carrier.

In another embodiment of an image forming apparatus, a controller compares an accumulated number of times for a sheet winding around an image carrier with a reference number of times for comparison, and when the accumulated number of times exceeds the reference number of times for comparison, it executes display control so that an image that urges placing of sheet-turning inside out or placing of conveyance direction reversing for a sheet stored in a storing member may be displayed. Owing to this display control, phenomena of winding of a sheet around an image carrier caused by the direction of occurrence of burrs on a cut sheet can be reduced, and the number of times of jam processing to remove a sheet from an image carrier can be reduced extremely.

In still another embodiment of an image forming apparatus, a controller detects an operation to change the placing direction of a sheet stored in a storing member, and it resets the accumulated number of tunes based on the detected operations for the change, thus, jam occurrence can be detected (watched) newly based on sheet winding detection signals obtained by detecting whether the sheet has wound around the image carrier or not.

In the further another embodiment of an image forming apparatus, a controller accumulates the number of times for a sheet winding around an image carrier for each storing member, then, detects an operation to change the placing direction of a sheet stored in each storing member, and it resets the number of times accumulated for each storing member based on the detected operations for the change, thus, jam occurrence can be detected (watched) newly based on sheet winding detection signals obtained by detecting whether the sheet has wound around the image carrier or not.

In the still another embodiment of an image forming apparatus, there is provided a sheet separation detecting section that detects a sheet separated from an image carrier, and a controller executes a display control that urges a change of a placing direction for a sheet stored in a storing member based on sheet separation detection signals outputted from a sheet separation detecting section, therefore, it becomes possible to display an image that urges a change of a placing direction for a sheet, corresponding to the state of separation of a sheet from an image carrier. Through this display, it becomes possible to confirm an indication of placing of sheet-turning inside out or conveyance direction reversing for a sheet stored in a storing member. This makes it possible to reduce phenomena for a sheet caused by the direction of occurrence of burrs on a cut sheet, and to reduce extremely jam releasing operations for removing a sheet wound around an image carrier.

In still another embodiment of an image forming apparatus, a controller displays, on a display section, an image that urges placing of conveyance direction reversing for a sheet stored in a storing member, in the case where establishment for front and back sides is registered for each storing member by an operation section and when the accumulated number of times exceeds a reference number of times for comparison, thereby, it becomes possible to confirm indication of placing of conveyance direction reversing for a sheet stored in a storing member. Owing to this, it becomes possible to reduce sheet winding phenomena which are caused by the direction of occurrence of burrs on a cut sheet, and it becomes possible to reduce jam clearance operations for removing sheets from an image carrier.

In still another embodiment of an image forming apparatus, a controller detects changing operations for conveyance direction reversing for a sheet stored in a storing member, and it conducts direction reversing for a position of an image to be formed on the image carrier based on the aforesaid changing operations thus detected. Therefore, even when establishment for front and back sides of a sheet is registered, it is possible to cause a position of the image to agree with a position before direction reversing.

In still another embodiment of an image forming apparatus, a controller displays an image that urges an operator for placing of sheet-turning inside out or placing of conveyance direction reversing for a sheet stored in a storing member, which makes it possible to confirm indication of placing of sheet-turning inside out or placing of conveyance direction reversing for a sheet stored in a storing member.

In still another embodiment of an image forming apparatus, there is provided a controller that executes sheet reversing and conveyance control that reverses the conveyance direction for a sheet stored in a storing member, based on sheet winding detection signals outputted from a winding detection section that detects whether the sheet has wound itself around an image carrier or not.

Owing to this constitution, it becomes possible to reduce phenomena of sheet winding around an image carrier which are caused by the direction of occurrence of burrs on a cut sheet, and it becomes possible to reduce jam clearance operations for removing sheets from an image carver, because it is possible to carry out automatic sheet-turning inside out for the conveyance direction of a sheet fed out from a storing member, and thereby to feed the sheet to the transfer section.

In still another embodiment of an image forming apparatus, a controller counts sheet winding signals, then, accumulates the number of times for the sheet to wind itself around an image carrier, to compare the accumulated number of times with a reference number of times for comparison, and when the accumulated number of times exceeds the reference number of times for comparison, the controller controls a sheet reversing and conveyance path so that the conveyance direction of the sheet conveyed from a storing member may be reversed. Therefore, when the sheet winds itself around the image carrier for the prescribed number of times, it becomes possible to feed the sheet to the transfer section by reversing the conveyance direction of the sheet fed out of the storing member automatically in the sheet reversing and conveyance path.

In still another embodiment of an image forming apparatus, a controller reverses the conveyance direction for a sheet conveyed from a storing member based on sheet separation detection signals, or it controls a sheet reversing and conveyance path so that the conveyance direction may be kept as it is. Therefore, when the sheet winds itself around the image carrier for the prescribed number of times, it becomes possible to branch automatic sheet-turning inside out control of a sheet fed out of the storing member, or display control for placing of conveyance direction reversing.

In the embodiment of the image forming system, there is provided an image forming apparatus relating to the present invention, and a controller for the image forming apparatus is one that executes a sheet reversing and conveyance control which reverses the conveyance direction for the sheet stored in a storing member based on the sheet winding detection signals.

Since it is possible to execute automatic sheet-turning inside out control for a sheet stored in a storing member of a sheet feed device, or display control for placing of conveyance direction reversing, in the aforesaid constitution, it becomes possible to reduce phenomena of sheet winding around an image carrier which are caused by the direction of occurrence of burrs on a cut sheet, and it becomes possible to reduce jam clearance operations for removing sheets from an image carrier.

In another embodiment of an image forming system, a controller of an image forming apparatus counts sheet winding signals, then, accumulates the number of times for the sheet to wind itself around an image carrier, to compare the accumulated number of times with a reference number of times for comparison, and when the accumulated number of times exceeds the reference number of times for comparison, the controller controls a sheet reversing and conveyance path so that the conveyance direction of the sheet conveyed from a storing member to an image forming apparatus may be reversed, thus, it becomes possible to execute automatic sheet-turning inside out control for a sheet stored in a storing member of a sheet feed device, or the display control for placing of conveyance direction reversing.

What is claimed is:

1. An image forming apparatus comprising:

(a) a sheet conveyance section having a sheet storing member to store sheets that have been aligned in a prescribed placing direction, which conveys a sheet stored in the sheet storing member;

(b) an image forming section having an image carrier, which forms an image on the image carrier;

(c) an image transfer section which transfers the image formed on the image carrier onto a sheet conveyed by the sheet conveyance section;

(d) a winding detecting section which detects whether or not the sheet conveyed by the sheet conveyance section is wound around the image carrier;

(e) a display section which displays an image to instruct an operator; and (f) a controller which controls the display section to instruct the operator to conduct a change operation of a placing direction in a front and rear side direction or a leading and trailing edge direction of the sheets stored in the sheet storing member based on a sheet winding detection signal outputted from the winding detection section only after an accumulated number of times that sheets have been wound around the image carrier exceeds a reference number of times for comparison;

wherein the controller receives an input of the sheet winding detection signal outputted from the winding detection section, accumulates a number of times that sheets have been wound around the image carrier by counting the sheet winding detection signal, compares the accumulated number of times with the reference number of times for comparison, and controls the display section to instruct the operator to conduct the change operation of the placing direction in the front and rear side direction or the leading and trailing edge direction of the sheets stored in the sheet storing member when the accumulated number of times exceeds the reference number of times for comparison;

wherein a tray sensor section provided in the sheet storing member detects the change operation of the placing direction in the front and rear side direction or the leading and trailing edge direction of the sheets stored in the sheet storing member that has been conducted by the operator, and the controller resets the accumulated number of times of windings based on the change operation detected; and wherein when the sheet conveyance section has a plurality of sheet storing members, the controller accumulates the number of times that sheets that have been wound around the image carrier for each of the sheet storing members, the tray sensor section detects the change operation in the front and rear side direction or the leading and trailing edge direction of the placing direction of the sheets stored in the sheet storing member for each of the sheet storing members, and the controller resets the accumulated number of times based on the change operation detected for each of the sheet storing members.

2. The image forming apparatus of claim 1, further comprising a sheet separation detection section which detects a sheet separated from the image carrier, and outputs a sheet separation detection signal, wherein the controller controls the display section to instruct the operator to conduct the change operation of the placing direction in the front and rear side direction or the leading and trailing edge direction of the sheets stored in the sheet storing member based on the sheet separation detection signal outputted from the sheet separation detection section.

3. The image forming apparatus of claim 1, further comprising an operation section which registers establishment for front and back sides of a sheet in which both sides of the sheet indicate characteristics different from each other, wherein when the establishment of the front and rear sides of the sheet is registered for each of the sheet storing members, and when the accumulated number of times exceeds the reference number of times for comparison, the controller controls the display section to instruct the operator to place the sheets stored in the sheet storing member with the leading and trailing edge direction thereof reversed.

4. The image forming apparatus of claim 3, wherein the controller detects the change operation of the leading and trailing edge direction of the sheets stored in the sheet storing member, and reverses a position of an image to be formed on the image carrier based on the detected change operation by changing the leading and trailing edge direction of the sheets.

5. The image forming apparatus of claim 1, wherein the controller controls the display section to display an image which instructs the operator to turn the sheets stored in the sheet storing member upside down or to reverse the leading and trailing edge direction of the sheets stored in the sheet storing member.

* * * * *